US007970160B2

(12) United States Patent
Hiramoto

(10) Patent No.: US 7,970,160 B2
(45) Date of Patent: Jun. 28, 2011

(54) SPEAKER APPARATUS

(75) Inventor: Mitsuhiro Hiramoto, Kobe (JP)

(73) Assignee: Fujitsu Ten Limited, Hyogo-ku, Kobe-shi, Hyogo (JP)

( * ) Notice: Subject to any disclaimer, the term of this patent is extended or adjusted under 35 U.S.C. 154(b) by 1346 days.

(21) Appl. No.: 10/863,290

(22) Filed: Jun. 9, 2004

(65) Prior Publication Data

US 2006/0153413 A1 Jul. 13, 2006

(30) Foreign Application Priority Data

Jun. 9, 2003 (JP) ..... P2003-164414
Jun. 9, 2003 (JP) ..... P2003-164415
Jun. 11, 2003 (JP) ..... P2003-166028

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 1/02*** | (2006.01) |
| ***H04R 1/20*** | (2006.01) |

(52) U.S. Cl. ..... 381/397; 381/345; 381/386; 381/412

(58) Field of Classification Search ..... 381/336, 381/346, 386, 396, 397, 182, 412, 345
See application file for complete search history.

(56) References Cited

U.S. PATENT DOCUMENTS 2,857,478 A * 10/1958 Harris ..... 381/182
4,837,839 A * 6/1989 Andrews ..... 381/182
5,532,437 A * 7/1996 Simplicean et al. ..... 181/150
5,548,657 A * 8/1996 Fincham ..... 381/182
6,002,780 A * 12/1999 Espiritu ..... 381/182
6,064,744 A * 5/2000 Augustin ..... 381/160
6,535,613 B1 * 3/2003 Ssutu ..... 381/397
6,711,269 B2 * 3/2004 Kobayashi et al. ..... 381/412
6,996,247 B2 * 2/2006 Stiles ..... 381/412
2001/0028724 A1 10/2001 Kowaki et al.

(Continued)

FOREIGN PATENT DOCUMENTS

EP 1 107 639 A2 6/2001

(Continued)

OTHER PUBLICATIONS

U.K. Office Action issued on Dec. 15, 2005.

(Continued)

*Primary Examiner* — Curtis Kuntz
*Assistant Examiner* — Jesse A Elbin
(74) *Attorney, Agent, or Firm* — Harness, Dickey & Pierce, PLC

(57) ABSTRACT

A speaker apparatus which does not need insertion of a stand into a speaker box, and which can prevent vibrations occurring in a speaker unit from transmitting to the speaker box by the speaker apparatus itself is provided. Within a speaker box which can be divided into first and second half portions, a plurality of supports extending from a main body portion of a weight radially are fixed at a connecting portion of the speaker box by bolts. A driving portion of a speaker unit is coupled to the main body portion of the weight, and is supported inside the speaker box in a manner that vibrations do not transmit, by the main body portion of the weight acting as a virtual ground. In order to swing the speaker box, a stand and the speaker box are pivotally supported by a pivotally supporting mechanism.

1 Claim, 30 Drawing Sheets

U.S. PATENT DOCUMENTS

| | | | |
|---|---|---|---|
| 2001/0042657 | A1 | 11/2001 | Yoshii et al. |
| 2002/0021818 | A1 | 2/2002 | Kowaki et al. |
| 2002/0057821 | A1 | 5/2002 | Tsumori et al. |
| 2002/0114485 | A1 | 8/2002 | Ohira et al. |
| 2003/0047378 | A1 | 3/2003 | Yoshii et al. |
| 2003/0226712 | A1 | 12/2003 | Nishikawa et al. |
| 2003/0228022 | A1 | 12/2003 | Nishikawa et al. |
| 2004/0017920 | A1 | 1/2004 | Nishikawa et al. |

FOREIGN PATENT DOCUMENTS

| | | | |
|---|---|---|---|
| EP | 1 120 992 | A2 | 8/2001 |
| EP | 1 120 992 | A3 | 8/2001 |
| GB | 2 399 977 | A | 9/2004 |
| JP | 60-19396 | | 1/1985 |
| JP | 03-117300 | | 5/1991 |
| JP | A 5-344575 | | 12/1993 |
| JP | 6-233367 | A | 8/1994 |
| JP | 7-95689 | A | 4/1995 |
| JP | 11-146471 | | 5/1999 |
| JP | 11-146472 | | 5/1999 |
| JP | 11-289588 | | 10/1999 |
| JP | 11-289588 | A | 10/1999 |
| JP | 2000-41292 | A | 2/2000 |
| JP | 2001-78285 | | 3/2001 |
| JP | 2001-78285 | A | 3/2001 |
| JP | 2001-224089 | | 8/2001 |
| JP | 2001-285974 | | 10/2001 |
| JP | 2001-352591 | | 12/2001 |
| JP | 2001-352592 | | 12/2001 |
| JP | 2002-152884 | | 5/2002 |
| JP | 2002-209293 | | 7/2002 |
| JP | 2002-247675 | | 8/2002 |
| JP | 2004-9924 | | 1/2004 |
| JP | 2004-15565 | | 1/2004 |
| JP | 2004-15566 | | 1/2004 |

OTHER PUBLICATIONS

Combined U.K. Search and Examination Report dated May 15, 2007 for counterpart U.K. Patent Application No. GB 0704637.8 is provided for the purposes of certification under § 1.97(e).

U.K. Combined Search and Examination Report dated Jul. 25, 2006.

* cited by examiner

SPEAKER APPARATUS

BACKGROUND OF THE INVENTION

1. Field of the Invention

The present invention relates to a speaker apparatus used for audio reproduction and so on.

Further, the present invention relates to a supporting apparatus which supports a speaker apparatus or the like so that the speaker apparatus is positioned away from a floor surface or the like, and which enables changing of facing direction of the speaker apparatus.

Further, the present invention relates to a speaker structure, more specifically, relates to a speaker structure comprising a speaker unit in which a through hole is formed in a magnetic circuit portion.

2. Description of the Related Art

Since before, a speaker apparatus capable of sound reproduction of high sound quality in a wide frequency band has been demanded in audio reproduction. In order to extend a frequency band toward low-pitched sounds, it is necessary to use a speaker apparatus in which a speaker of large caliber is placed in a speaker box having a large capacity. In a speaker, acoustic vibrations are propagated to the surrounding air from a vibration board driven to vibrate by a driving portion of, for example, electrodynamic type provided with a magnetic circuit and a voice coil. A reaction force from the surrounding air is transmitted to the vibration board, and the driving portion also vibrates in response to the acoustic vibrations propagated to the air. These vibrations are transmitted to the speaker box, whereby the surface of the speaker box vibrates, and acoustic output by these vibrations is also radiated to the surrounding air. Since this acoustic output contains a phase shift and distortion as compared with acoustic output radiated from the vibration board, the sound quality of acoustic output radiated from the speaker degrades.

Further, in many cases, a speaker of large caliber for low-pitched sounds is installed in a speaker box having a large capacity, and a speaker of small caliber for high-pitched sounds is disposed independently from the speaker for low-pitched sounds. The applicant disclosed a speaker system in which a speaker box having a relatively small capacity can be divided into a first half portion and a second half portion, an opening portion is disposed to the first half portion to connect a sound radiation portion of a full-range speaker unit of relatively small caliber via a cushioning material, and the speaker unit is supported inside the speaker box (refer to Japanese Unexamined Patent Publication JP-A 2001-285974 (FIGS. 1 and 17), for example). The speaker unit is directly supported by a stand whose front end is inserted into the speaker box from a connecting portion between the first half portion and the second half portion of the speaker box, whereby vibrations occurring in, for example, a driving portion of the speaker unit is hard to propagate to the speaker box.

In the speaker system as disclosed in JP-A 2001-285974 (FIGS. 1, 17), the front end of the stand outside the speaker box is inserted into the speaker box to support the speaker unit. Since the cushioning material or the like is disposed to a place where the stand is inserted into the speaker box so that acoustic output inside the speaker box does not leak outside, it is impossible to cause the speaker box to swing on the stand. In the case of reproduction of high-pitched sounds, the directivity is strong for acoustic output radiated from the speaker. In the case of executing stereo reproduction by placing the speaker system in spatially separate positions, for example, on the right side and the left side, it is preferable to direct the speaker system toward a listener.

FIG. 26 schematically shows a supporting structure 50 which enables a swing. A spherical body 52 is installed in a supporting object 51, and the spherical body 52 is covered by a shell member 54 having a groove into which a shaft 53 extending outward in a radial direction from a part of the spherical body pierces and the shell member 54 is fixed by a bolt 55. With the bolt 55 slightly loosened, an angular displacement about the shaft 53 and a swing displacement of the shaft 53 along the groove become possible in the supporting structure 50. It is possible fix the direction of the shaft 53 by fasten the bolt 55 when the shaft 53 is set in a desired direction.

In the case of using the supporting structure 50 as shown in FIG. 26 in a speaker system, it is necessary to house an approximately half portion of the spherical body 52 into the speaker box as the supporting object 51. Since the speaker system has a weight even if relatively small, the diameter of the spherical body 52 must be large to a certain extent. As the spherical body 52 becomes large, the capacity of the speaker box becomes small because the speaker box houses the half portion of the spherical body.

FIG. 27 shows a state where the major portion of the spherical body 52 is put outside the supporting object 51 in order to avoid that the capacity of the sneaker box becomes small. However, in this case, the spherical body 52 and the supporting object 51 tend to become unstable because a contact area thereof is small. Moreover, since the major portion of the spherical body 52 is put outside the supporting object 51, a height h of the supporting structure becomes large.

FIG. 28 is a sectional side view schematically showing a conventional speaker structure.

A speaker unit 100 comprises a magnetic circuit portion 120, a vibrating portion 130 and a frame 140. The magnetic circuit portion 120 includes a yoke 121 made of a magnetic substance such as iron, an annular magnet 122 placed on a front face side of the yoke 121, and an annular top plate 123 placed on the front face side of the magnet 122. The yoke 121 is composed of a columnar center pole 121*a* and a back plate 121*b*, and a through hole 124 for air bleed is formed on the central axis of the center pole 121*a*. Moreover, the magnet 122 is placed in a manner that the central axis of the magnet 122 coincides with the central axis of the center pole 121*a*.

The vibrating portion 130 includes a cone 131 having a substantially truncated cone shape, an edge 132 adhered and fixed to one end on a front face side of the cone 131, a cylindrical voice coil bobbin 133 adhered and fixed to another end on a rear side of the cone 131, a voice coil 139 wound around an outer periphery of the voice coil bobbin 133, an annular damper 135 adhered and fixed to the voice coil bobbin 133 and the frame 140, a center cap 136 for capping a central portion of the cone 131, and the like.

The frame 140 is a member for fixing the magnetic circuit portion 120 and the vibrating portion 130, and is formed in a substantially truncated cone shape. A front opening portion of the frame 140 is adhered and fixed to the cone 131 via the edge 132. A rear portion of the frame 140 is adhered and fixed to the top plate 123 of the magnetic circuit portion 120. A hole (not shown) for regulating back pressure of the cone 131 is formed in a predetermined position on a sidewall surface of the frame 140.

When the voice coil 134 of the speaker unit 100 is energized, a driving force acts on the voice coil 134 in a magnetic gap, the cone 131 displaces, and sound waves are radiated from the cone 131 to the surroundings. At this moment, the voice coil 134 generates heat, and this heat is radiated from a gap between the top plate 123 and the center pole 121*a* to an interior space 141 of the speaker unit 100, and transmitted to the respective members such as the yoke 121.

According to the speaker unit 100, since the through hole 124 is formed in the yoke 121, the high-temperature air is discharged from the interior space 141 to a back face side via the through hole 124 when the cone 131 is pressed backward, and the outside air is sucked into the interior space 141 from the back face side via the through hole 124 when the cone 131 is drawn back forward. As a result, it is possible to increase a heat radiation characteristic of the interior space 141, and it is possible to increase the cooling efficiency of the yoke 121.

FIG. 29 is a sectional side view schematically showing another conventional speaker structure. Here, since a speaker unit 100A is almost the same as the speaker unit 100 shown in FIG. 29 except that a screw hole 250 with a screw thread cut is formed instead of the through hole 124 for air bleed formed in the yoke 121, a yoke and the screw hole will be denoted by different reference numerals 210 and 250, respectively, and the other components having the same functions will be denoted by the same reference numerals and and a description thereof will be omitted.

A speaker apparatus 101 comprises the speaker unit 100A and a weight 150 fixed on the back face side of the speaker unit 10A.

A main body portion 151 of the weight 150 is made of metal having a high specific gravity such as iron, stainless steel and lead, and has a larger weight than that of the speaker unit 100A.

A front face of the main body portion 151 having a substantially truncated cone shape is formed by a plane surface except a protruding port-on 152 in the center, and a through hole 153 for inserting a bolt 160 is formed along the central axis of the main body portion 151.

The speaker unit 100A and the weight 150 are combined by inserting the bolt 160 into the through hole 153 from the back face side of the weight 150, and inserting and screwing a front end portion of the bolt 160 protruded from the protruding portion 152 of the weight 150 into the screw hole 250 disposed to the back face of the yoke 210.

According to the speaker apparatus 101, since the weight 150 is fixed on the back face side of the magnetic circuit portion 120 of the speaker unit 100A, even if a reaction force occurring at the time of radiation of sound waves from the cone 131 transmits to the magnetic circuit portion 120, the weight 150 works as a virtual ground, with the result that vibrations are suppressed, and a sound quality with fine transient characteristic can be obtained (refer to Japanese Unexamined Patent Publication JP-A 2002-152884).

FIG. 30 is a sectional side view schematically showing a conventional two-way type of speaker structure. Here, components having the same functions as those of the speaker unit 100 shown in FIG. 28 will be denoted by the same reference numerals and a description thereof will be omitted.

A speaker unit 101A comprises a main speaker unit 110 having the magnetic circuit portion 120, the vibrating portion 130 and the frame 140, a center support 170 fixed on the front face side of the center pole 121*a* of the magnetic circuit portion 120, and a tweeter unit 112 adhered and fixed on the front face side of the center support 170.

A through hole 250A for inserting a bolt 160A is formed along the central axis of the magnetic circuit portion 120 (the center pole 121*a*) of the main speaker unit 110. Moreover, a screw hole 171 for screwing the bolt 160A is formed in the center support 170 made of a nonmagnetic substance (resin, aluminum, stainless steel or the like).

The tweeter unit 112 is a speaker for high audio frequencies, and includes a magnetic circuit portion, a vibrating portion and a frame, which are not shown in the drawings.

The main speaker unit 110 and the center support 170 are combined by inserting the bolt 160A into the through hole 250A from the back face side of the magnetic circuit portion 120, and inserting and screwing a front end portion of the bolt 160A protruded from the through hole 250A into the screw hole 171 of the center support 170.

By a structure such that the tweeter unit 112 for high audio frequencies is attached to the main speaker unit 110 for medium and low audio frequencies, it is possible to output sounds of a wide band from low-pitched sounds to high-pitched sounds by the single speaker apparatus 101A. Such a two-way type of speaker structure is disclosed in, for example, Japanese Unexamined Patent Publication JP-A 2002-209293.

However, even if intending to attach the weight 150 shown in FIG. 29 to the speaker unit 100 having the through hole 124 for air bleed shown in FIG. 28, it is impossible to attach the weight 150 as it is because the through hole 124 is formed in the speaker unit 100. Moreover, although it is possible to attach by cutting a screw thread in the through hole 124 when the diameter of the bolt 160 is larger than the hole diameter of the through hole 124, the through hole 124 is filled with the bolt 160 when the bolt 160 is attached to the through hole 124, and therefore, there is a problem such that it is impossible to obtain an effect of air bleed by the through hole 124, that is, an effect of increasing the cooling efficiency of the magnetic circuit portion 120 by suck and discharge of the air.

Further, since the through hole 250A is filled with the bolt 160A in the two-way type of speaker apparatus 101A shown in FIG. 30, it is impossible to execute air bleed, and there is a problem such that the efficiency of heat radiation of the magnetic circuit portion 120 cannot be increased.

SUMMARY OF THE INVENTION

An object of the invention is to provide a speaker apparatus which does not need insertion of a stand into a speaker box, and which can prevent vibrations occurring in a speaker unit from transmitting to the speaker box by the speaker apparatus itself.

Another object of the invention is to provide a supporting apparatus which supports a relatively heavy supporting object such as a speaker apparatus in a state where the supporting object can swing, and which is capable of miniaturization.

Still another other object is to provide a speaker structure which enables attachment of a weight to a speaker unit whose magnetic circuit portion has a through hole for air bleed in a state where an air bleed effect by the through hole can be obtained, thereby further increasing an acoustic characteristics, and which makes it possible to obtain the air bleed effect even in a two-way type of speaker unit.

The invention provides a speaker apparatus comprising:

a speaker box provided with an opening portion;

a speaker unit having a sound radiation portion, the speaker unit being housed into the speaker box and the sound radiation portion being connected to the opening portion of the speaker box via a cushioning material;

a weight coupled to a back face side of the speaker unit in the speaker box, the weight being provided with a main body portion having mass enough to virtually act as a ground for acoustic vibrations and a supporting portion extending from the main body portion; and fixing members provided in the speaker box, for fixing the supporting portion.

In the invention, the supporting portion is a plurality of supports extending from the main body portion radially.

In the invention, the plurality of supports have mutually different shapes.

In the invention, in the respective supports, portions coupled to the fixing members of the speaker box have the same shape, and portions extending from the weight have different shapes.

In the invention, the weight has an indication indicating a fixing direction of the plurality of supports to the speaker box.

In the invention, the speaker box can be divided into at least two parts and the supporting portion is supported at a connecting portion of the two parts.

The invention provides a supporting apparatus for the aforementioned speaker apparatus, comprising:

a convex spherical member provided in the speaker box;

a sliding member formed in a spherical shell shape and having an inner surface capable of being slidingly displaced along a convex spherical surface of the convex spherical member;

a supporting member protruding from an outer surface of the sliding member; and a shell member coupled to the speaker box and having a nicked portion into which the supporting member pierces and a concave spherical surface for slidingly supporting an outer surface of the sliding member.

The invention provides a speaker structure mounted on the aforementioned speaker apparatus, comprising:

a speaker unit having a magnetic circuit portion provided with a first through hole; and a weight fixed on a back face side of the speaker unit and having a main body portion provided with a second through hole, wherein the weight is attached to the speaker unit in a state where the first through hole and the second through hole communicate with each other.

The invention provides a speaker structure mounted on the aforementioned speaker apparatus, comprising:

a speaker unit having a magnetic circuit portion provided with a through hole; and a weight fixed on a back face side of the speaker unit, wherein the weight is attached to the speaker unit in a state where a communicating portion which communicates from the through hole to an outside via the back face of the magnetic circuit portion is formed.

The invention provides a supporting apparatus for supporting a supporting object in a manner that the supporting object can swing, the supporting apparatus comprising:

a convex spherical member provided in the supporting object;

a sliding member formed in a spherical shell shape and having an inner surface capable of being slidingly displaced along a convex spherical surface of the convex spherical member;

a supporting member protruding from an outer surface of the sliding member; and a shell member coupled to the supporting object and having a nicked portion into which the supporting member pierces and a concave spherical surface for slidingly supporting an outer surface of the sliding member.

In the invention, the shell member is fastened to the supporting object in a manner that a fastening force can be adjusted.

In the invention, the supporting member has a plurality of leg portions which, as it is away from the sliding member, incline and spread out.

In the invention, front ends of the respective leg portions have through holes for fixing the respective leg portions to a base portion.

In the invention, the convex spherical member is formed integrally with at least part of the supporting object.

In the invention, at least one place of the convex spherical member is provided with a groove.

In the invention, the groove is provided at a position excluding a position opposite to the nicked portion of the shell member.

The invention provides a speaker structure, comprising:

a speaker unit having a magnetic circuit portion provided with a first through hole; and a weight fixed on a back face side of the speaker unit and having a main body portion provided with a second through hole, wherein the weight is attached to the speaker unit in a state where the first through hole and the second through hole communicate with each other.

The invention provides a speaker structure, comprising:

a speaker unit having a magnetic circuit portion provided with a through hole; and a weight fixed on a back face side of the speaker unit, wherein the weight is attached to the speaker unit in a state where a communicating portion which communicates from the through hole to an outside via the back face of the magnetic circuit portion is formed.

In the invention, the weight is attached to the speaker unit by a fixing member in a state where a gap is disposed between the speaker unit and the weight, and the communicating portion is formed by the gap.

In the invention, the weight has a first groove portion formed in the radial direction from a place facing the through hole on a surface facing the back face of the speaker unit, and the communicating portion is formed by the first groove portion.

In the invention, the magnet-c circuit portion has a second groove portion formed on a surface facing the weight from the through hole in the radial direction, and the communicating portion is formed by the second groove portion.

In the invention, the weight has, in a place facing the through hole, air flow smoothing means for smoothing a flow of air passing through the through hole.

In the invention, a through hole opening of the through hole is processed into a tapered shape.

The invention provides a speaker structure, comprising:

a main speaker unit having a magnetic circuit portion provided with a third through hole;

a supporting member having a hole portion communicating with the third through hole and a fourth through hole pierced from an inner wall surface of the hole portion to an outer peripheral surface of the supporting member; and a sub speaker unit fixed to the main speaker unit via the supporting member.

In the invention, at least the main speaker unit and the supporting member are fixed by a fixing member inserted into the third through hole and the hole portion, and the fixing member has a groove portion or a fifth through hole for forming a communicating passage which runs from the fourth through hole to the back face side of the magnetic circuit portion via the hole portion and the third through hole.

In the invention, the main speaker unit has a third groove portion formed along an inner wall surface of the third through hole, the supporting member has a fourth groove portion formed communicating with the fourth through hole along the inner wall surface of the hole portion, the main speaker unit and the supporting member are fixed by a fixing member inserted into the third through hole and the hole portion, and a communicating passage which runs from the fourth through hole to the back face side of the magnetic circuit portion via the fourth groove portion and the third groove portion is formed.

In the invention, the fixing member is formed by a screw tool having a head portion and a foot portion, and a fixing auxiliary member in which concave portions and convex portions is formed in an annular shape is interposed between the back face of the magnetic circuit portion and the head portion of the screw tool.

In the invention, the speaker structure further comprises a weight fixed on the back face side of the main speaker unit and having a main body portion provided with a second through hole, wherein the weight is attached to the main speaker unit in a state where the fourth through hole, the hole portion, the third through hole and the second through hole communicate mutually.

In the invention, the speaker structure further comprises a weight fixed on the back face side of the main speaker unit, wherein the weight is attached to the main speaker unit in a state where a communicating portion for making the communicating passage and an outer peripheral side of the magnetic circuit portion communicate with each other is formed.

According to the invention, in the speaker apparatus, the speaker unit is supported in the speaker box that can be divided into the first half port-on and the second half portion, and the sound radiation portion of the speaker unit is connected to the opening portion of the first half portion of the speaker box via the cushioning material. Vibrations of the speaker unit itself caused by a reaction force when the speaker unit makes acoustic output propagate to the surrounding air are damped by the cushioning material, and are hard to transmit to the speaker box. Inside the speaker box, the speaker unit is coupled to the main body portion of the weight. The main body portion of the weight has large mass enough to virtually act as a ground for acoustic vibrations, so that the acoustic impedance becomes sufficiently high as compared with the air that the sound radiation portion of the speaker unit makes acoustic output propagate, and the weight hardly vibrates even if the weight is subject to a reaction force accompanying radiation of acoustic output to the air. The plurality of supports having a radially extending shape extend from the main body portion of the weight toward the connecting portion between a first half portion and a second half portion of the speaker box, and the fixing members fix the supports, respectively, at the connecting portion of the speaker box, so that it is possible to support the weight inside the speaker box. The speaker unit is coupled to the main body portion of the weight, and it is possible, by the main body portion of the weight acting as a virtual ground, to support the speaker unit inside the speaker box in a manner that vibrations do not transmit. Even when using a stand or the like in order to position the speaker box away from a floor surface, a wall surface or the like of a room to execute sound reproduction, it is not necessary to insert the stand into the speaker box and directly support the speaker unit, and it is also possible to, for example, cause the speaker box to swing in a state where the stand and the speaker box are pivotally supported.

According to the invention, the main body portion of the weight coupled to the speaker unit inside the speaker box virtually acts as a ground for acoustic vibrations, so that it is possible to make the weight hardly vibrate even when the weight is subject to a reaction force accompanying radiation of acoustic output to the air from the sound radiation portion of the speaker unit. Since the plurality of supports having a shape radially extending from the main body portion the weight are fixed at the connecting portion between the first half portion and the second half portion of the speaker box, it is possible to support the weight inside the speaker box, and even when using a stand or the like, it is not necessary to insert the stand into the speaker box and directly support the speaker unit, and it is also possible to, for example, cause the speaker box to swing in a state where the stand and the speaker box are pivotally supported.

According to the invention, the plurality of supports have mutually different shapes, so that frequencies of vibrations that the supports resonate are different from each other, and it is possible to prevent that vibrations increase in a specific frequency. Since the indication relating to the difference in shapes of the supports is disposed, it is possible to avoid a mistake of a direction of fixing the weight within the speaker box even when the difference in shapes is hard to visually confirm. For example, in the case of executing two-channel stereo reproduction by placing a pair of speaker apparatuses on the right and left, it is possible to avoid that the directions of the weights of the speaker apparatuses differ on the right and left.

According to the invention, it is possible to set mutually different resonance frequencies by making the plurality of supports extend outward from the main body portion of the weight in a circumferential direction at equal intervals and have almost the same shape, and differentiating the shapes of the portions extending outward from the main body portion of the weight. Since front ends of the supports fixed by the fixing members at the connecting portion between the first half portion and the second half portion of the speaker box, can be formed into the same shape, fixing members of the same standards can be used as the fixing members.

According to the invention, the supporting apparatus that pivotally supports the supporting object to be capable of swinging comprises the convex spherical member, the sliding member, the shell member and the supporting member. The convex spherical member is disposed to the pivotally supporting portion of the supporting object in a manner that the partial spherical surface protrudes, and the sliding member can be slidingly displaced along the convex spherical surface. In the sliding member, the concave spherical surface partially fitting with the convex spherical surface of the convex spherical member is formed inward in the radial direction, and the convex spherical surface is formed outward in the radial direction. The shell member becomes the shell for covering the convex spherical surface of the convex spherical member via the sliding member, guides in a manner that the sliding member slides along the convex spherical surface of the convex spherical member, and has the nicked portion capable of coupling the convex spherical surface of the sliding member to the outside. The supporting member is coupled to the sliding member via the nicked portion of the shell member to support the supporting object via the sliding member and the convex spherical member. Since the shell member has the nicked portion, when the sliding member coupled to the supporting member via the nicked portion is slidingly displaced along the spherical surface of the convex spherical member, a swing displacement to change an angle formed by the supporting member and the supporting object becomes possible. An angular displacement about an axial line is also possible at a portion coupling the supporting member and the sliding member, so that it is possible to realize a pivotally supporting structure which, by the swing displacement and the angular displacement, enables the supporting object to swing on the supporting member. What is required is only to provide the supporting object with the convex spherical member whose partial spherical surface protrudes, so that the capacity of the supporting object does not become small, and it is possible to reduce the amount of protrusion to the outside and miniaturize the shape necessary for pivotally supporting.

According to the invention, by slidingly displacing the sliding member along the convex spherical surface of the convex spherical member disposed to the pivotally supporting portion of the supporting object in a manner that the partial spherical surface protrudes, and allowing the swing displacement and the angular displacement of the supporting member coupled to the sliding member via the nicked portion of the shell member, it is possible to cause the supporting object to swing on the supporting member. What is required is only to provide the supporting object with the convex spherical member whose partial spherical surface protrudes, so that the capacity of the supporting object does not become small, and it is possible to reduce the amount of protrusion to the outside and miniaturize the shape necessary for pivotally supporting.

According to the invention, when the bottom portions of the plural leg portions are placed on a floor surface, the axial line becomes perpendicular to the floor surface, so that the supporting member can support the supporting object at the coupling portion to be away from the floor surface. Since the through hole is disposed in a direction parallel to the axial line near the bottom portion of the leg portion, it is also possible to insert a bolt or the like into the through hole and fix the leg portion. Further, since it is possible to fix the leg portion by the through hole, it is also possible to fix the bottom portion of the leg portion to a ceiling, a sidewall or the like and support the supporting object.

According to the invention, since the convex spherical member is formed integrally with at least part of the supporting object, it is possible to reduce the number of components, and facilitate the assembly of the pivotally supporting portion.

According to the invention, since the nicked portion of the shell member has a shape extending along the convex spherical surface of the convex spherical member, when the coupling portion between the sliding member and the supporting member is displaced along this nicked portion, a swing displacement of the supporting member with respect to the supporting object becomes possible, and an angular displacement about the axial line of the coupling portion also becomes possible. Since the convex spherical member has the groove parallel to the nicked portion in a position away from the nicked portion, it is possible to prevent that the groove impairs the smoothness of the sliding portion at the time of the swing displacement of the supporting member with respect to the supporting object. As a result of disposing the groove to the convex spherical member, it is possible to prevent a sink mark at the time of forming the convex spherical member by molding of a synthetic resin material, casting of a metallic material or the like, and it is possible to smooth a sliding surface.

According to the invention, it is possible to easily change the direction of the speaker box by a relatively small-size pivotally supporting mechanism, and it is possible to avoid that the capacity of a speaker box decreases.

According to the invention, the weight is attached to the speaker unit in a state where the first through hole and the second through hole communicate with each other, so that it is possible to discharge the high-temperature air from an interior space of the speaker unit to the outside via the first through hole and the second through hole, and suck the outside air into the interior space of the speaker unit from the outside via the second through hole and the first through hole. Therefore, it is possible to obtain an effect of cooling the magnetic circuit portion by suck and discharge of air, and an effect of reducing a back pressure load which acts on a cone of the speaker unit and linearly causing the cone to execute an amplitude operation with respect to sound signals, that is, an effect by air bleed. Moreover, since the weight works as a virtual ground, it is possible to suppress vibrations of the speaker unit and cause the cone to efficiently output sound waves, so that it is possible to further increase an acoustic characteristics, and it is possible to obtain the effect by the weight simultaneously.

According to the invention, the weight is attached to the speaker unit in a state where the through hole and the communicating portion communicate with each other, so that it is possible to make an interior space of the speaker unit and the outside communicate with each other via the through hole and the communicating portion, and it is possible to obtain both the effect by air bleed and the effect by the weight as described above.

According to the invention, the weight is attached to the speaker unit by the fixing member in a state where the gap forming the communicating portion is disposed, so that it is possible to make the interior space of the speaker unit and the outside communicate with each other via the through hole and the gap, and it is possible to obtain both the effect by air bleed and the effect by the weight as described above.

According to the invention, it is possible to make the interior space of the speaker unit and the outside communicate with each other via the through hole and the first groove portion, and it is possible to obtain both the effect by air bleed and the effect by the weight as described above.

According to the invention, it is possible to make the interior space of the speaker unit and the outside communicate with each other via the through hole and the second groove portion, and it is possible to obtain both the effect by air bleed and the effect by the weight as described above.

According to the invention, it is possible to reduce the resistance of air discharged from the through hole and the resistance of air sucked into the through hole by the air flow smoothing means, and it is possible to further increase the effect by air bleed described above.

According to the invention, the through hole opening of the through hole is processed into a tapered shape, so that it is possible to reduce the resistance of air sucked into and discharged from the through hole, and it is possible to further increase the effect by air bleed described above.

According to the invention, it is possible to make an interior space of the main speaker unit and the outside communicate with each other by the fourth through hole, the hole portion and the third through hole, and it is possible to obtain the effect by air bleed as described above even in a two-way type of speaker structure.

According to the invention, even when at least the main speaker unit and the supporting member are fixed by the fixing member, it is possible to form the communicating passage by the fourth through hole and the groove portion or the fifth through hole formed in the fixing member, and make the interior space of the main speaker unit and the outside communicate with each other, and it is possible to obtain the effect by air bleed as described above even in a two-way type of speaker.

According to the invention, even when at least the main speaker unit and the supporting member are fixed by the fixing member, the communicating passage is formed by the fourth through hole, the fourth groove portion and the third through groove portion, so that it is possible to make the interior space of the main speaker unit and the outside communicate with each other, and it is possible to obtain the effect by air bleed as described above even in a two-way type of speaker.

According to the invention, it is possible to suck and discharge air of the communicating passage via openings of the concave and convex portions formed on the fixing auxiliary member, and even in a two-way type of speaker, it is possible to obtain the effect by air bleed as described above, and it is possible to securely fasten the screw tool by the fixing auxiliary member.

According to the invention, it is possible to make the interior space of the main speaker unit and the outside of the weight communicate with each other by the fourth through hole, the hole portion, the third through hole and the second through hole, it is possible to attach the weight in a state where the effect by air bleed as described above can be obtained even in a two-way type of speaker, it is possible to suppress vibrations of the main speaker unit and cause a cone to efficiently output sound waves, and it is possible to further increase an acoustic characteristics.

According to the invention, the weight is attached to the main speaker unit in a state where the communicating passage and the communicating portion communicate with each other, so that it is possible to make the interior space of the main speaker unit and the outside communicate with each other via the communicating passage and the communicating portion, it is possible to attach the weight in a state where the effect by air bleed as described above can be obtained even in a two-way type of speaker, and it is possible to obtain the effect by the weight.

BRIEF DESCRIPTION OF THE DRAWINGS

Other and further objects, features, and advantages of the invention will be more explicit from the following detailed description waken with reference to the drawings wherein;

FIG. 17A is a sectional side view taken on line A-A in FIG. 17B, and FIG. 17B is a front view of a weight;

FIG. 18A is a sectional side view taken on line A-A in FIG. 18B, and FIG. 18B is a back view of a yoke;

FIG. 19A is a sectional side view, and FIG. 19B is a sectional view taken on line B-B in FIG. 19A;

FIG. 20A is a sectional side view, FIG. 20B is a sectional view taken on line B-B in FIG. 20A, FIG. 20C is a side view of a screw tool in the speaker structure according to the tenth embodiment of the invention, FIG. 20D is a sectional perspective view taken on line B-B in FIG. 20C, and FIG. 20E is a perspective front view of a washer;

FIG. 21A is a side view, and FIG. 21B is a sectional view taken on line B-B in FIG. 21A;

FIG. 22A is a partial sectional side view, and FIG. 22B is a sectional view taken on line B-B in FIG. 22A;

FIG. 23A is a sectional side view, FIG. 23B is a sectional view taken on line B-B in FIG. 23A, and FIG. 23C is a sectional view taken on line C-C in FIG. 23A;

DETAILED DESCRIPTION

Figure 1:
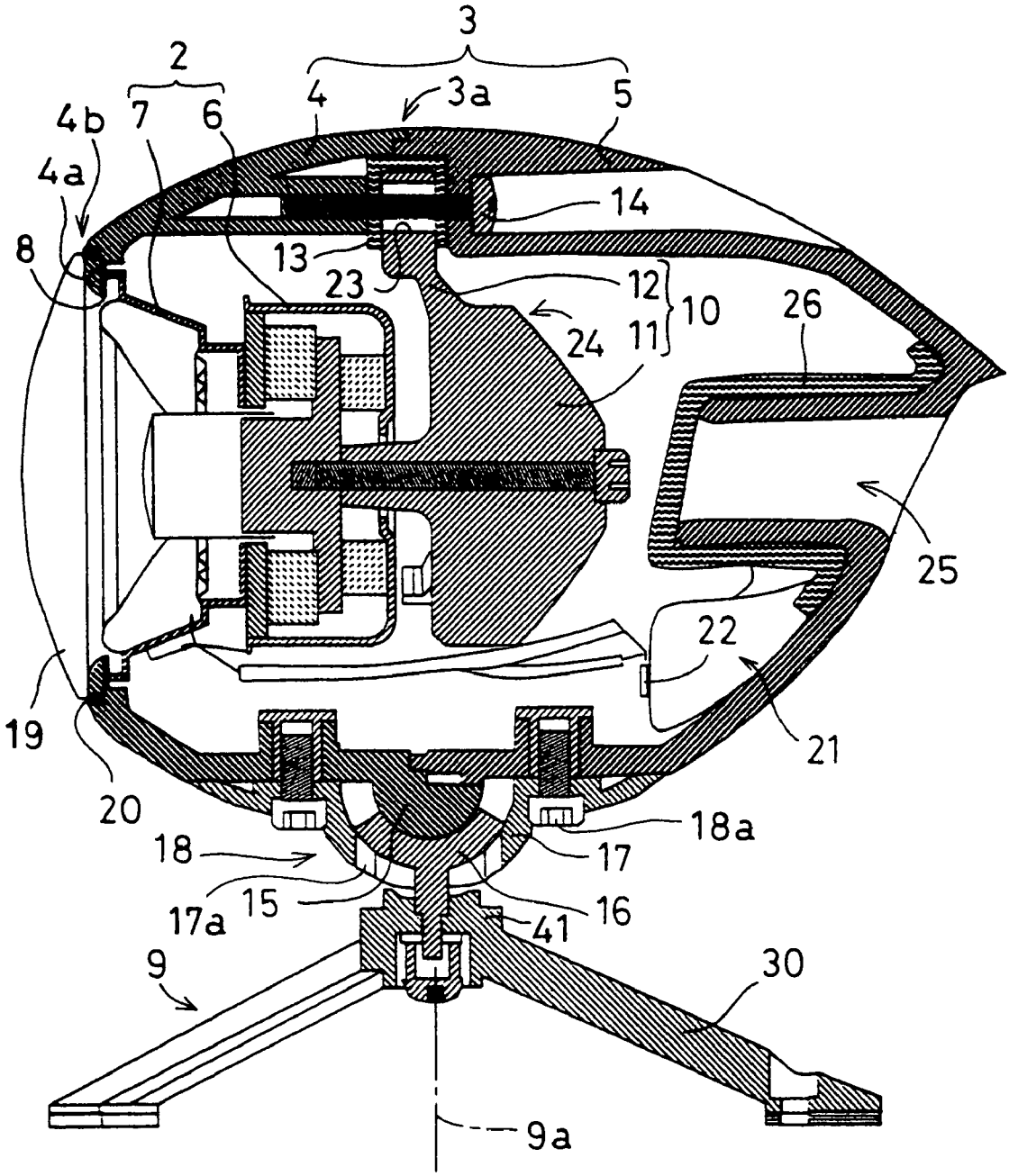
FIG. 1 is a sectional side view showing a schematic structure of a speaker apparatus according to a first embodiment of the invention.
Figure 2:
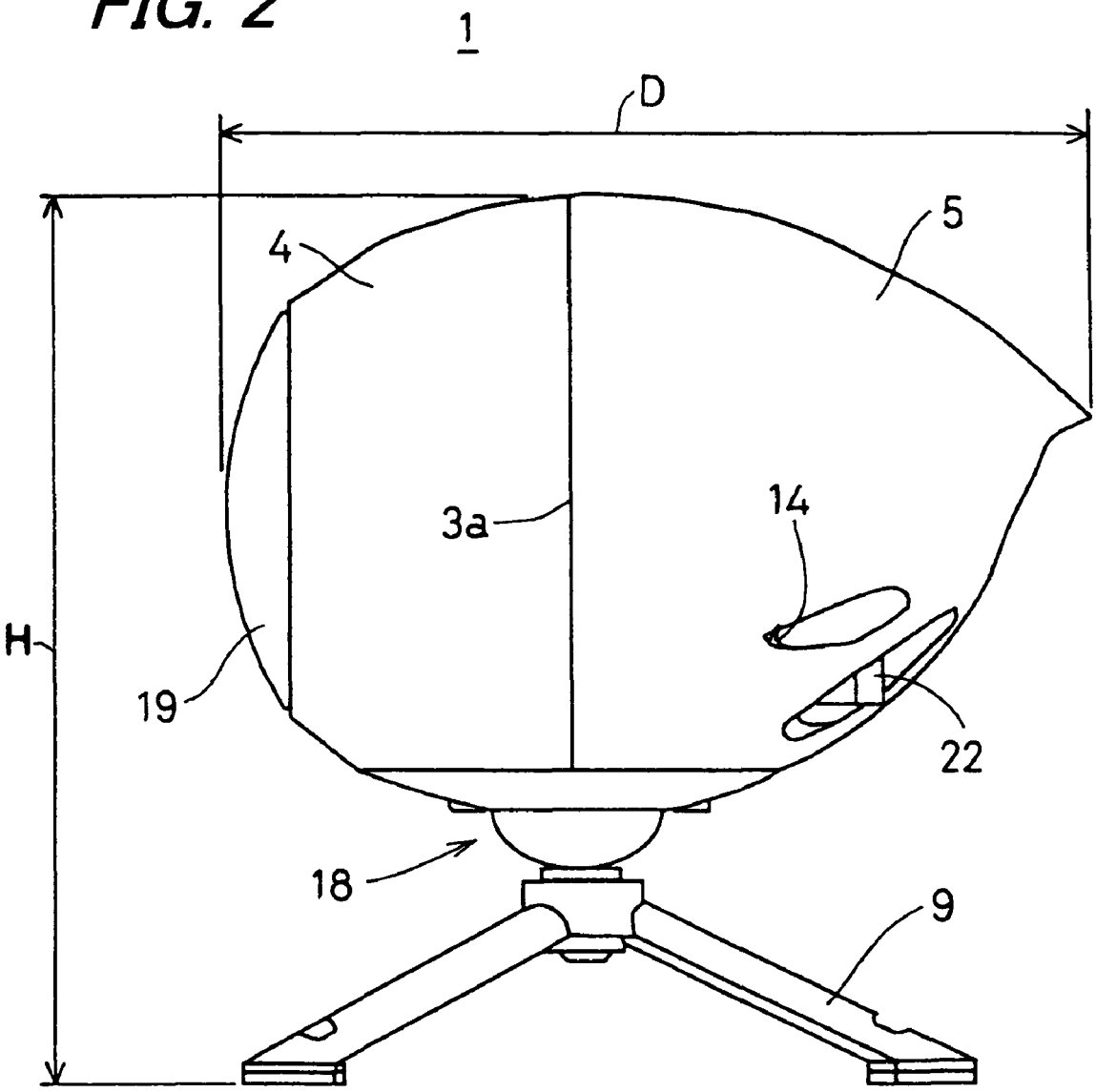
FIG. 2 is a side view of the speaker apparatus shown in FIG. 1.
Figure 3:
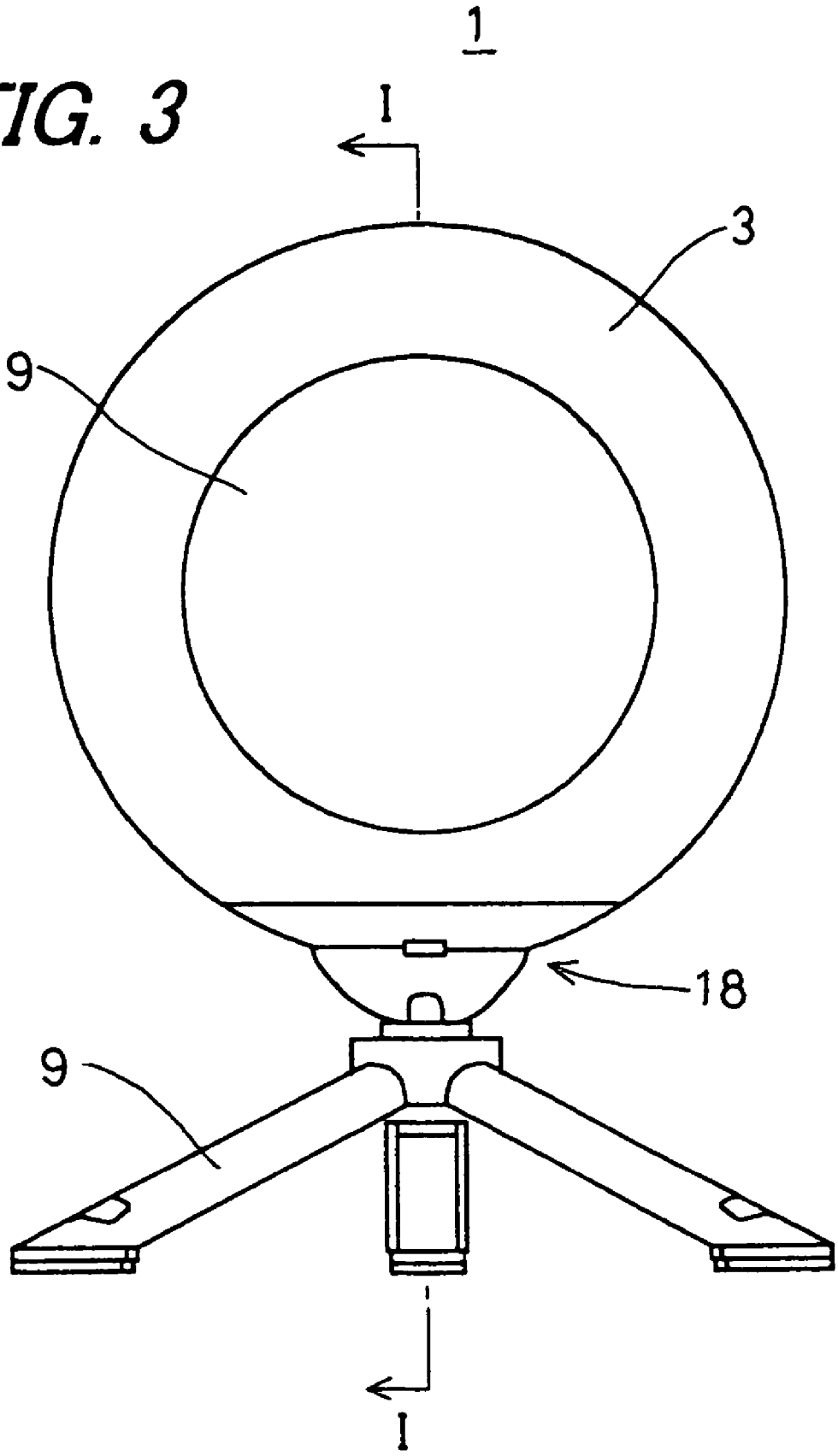
FIG. 3 is a front view of the speaker apparatus shown in FIG. 1.
Figure 4:
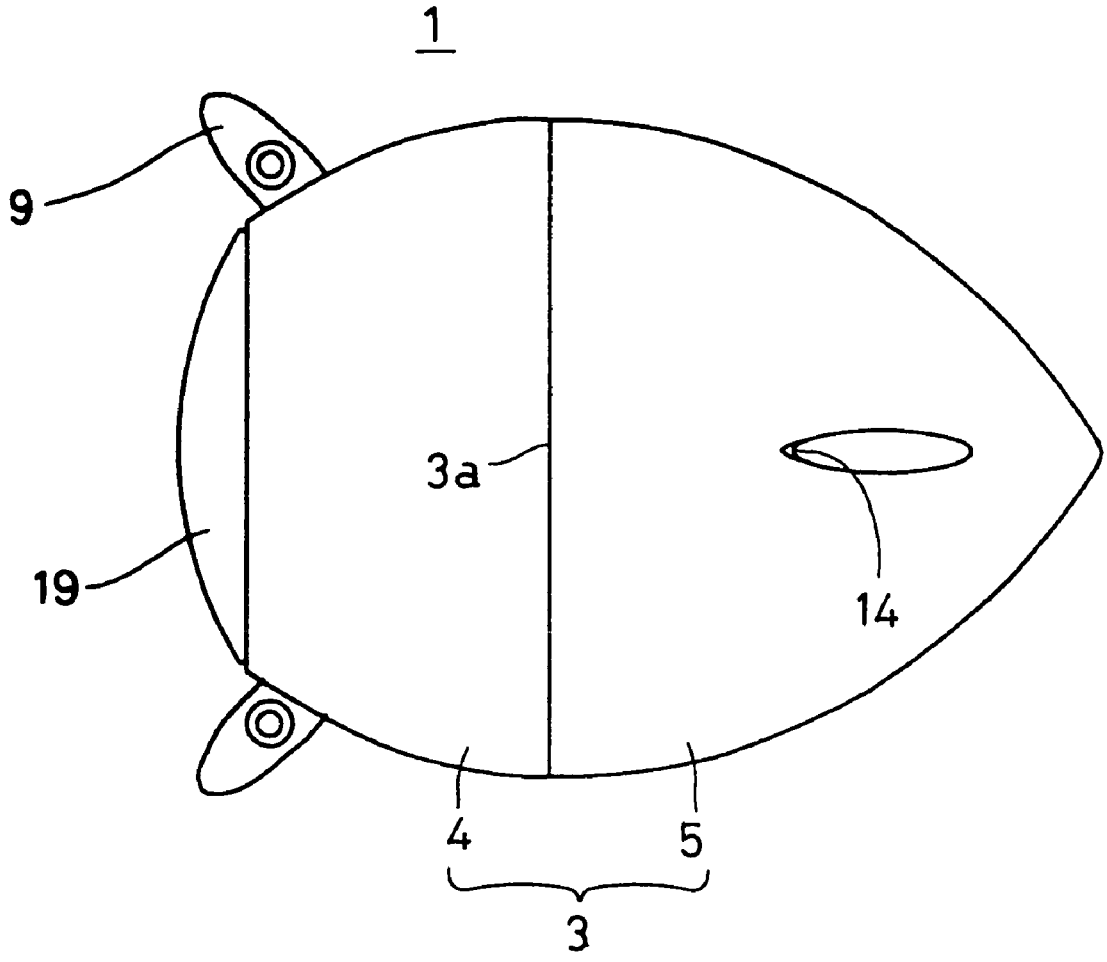
FIG. 4 is a plan view of the speaker apparatus shown in FIG. 1.
Figure 5:
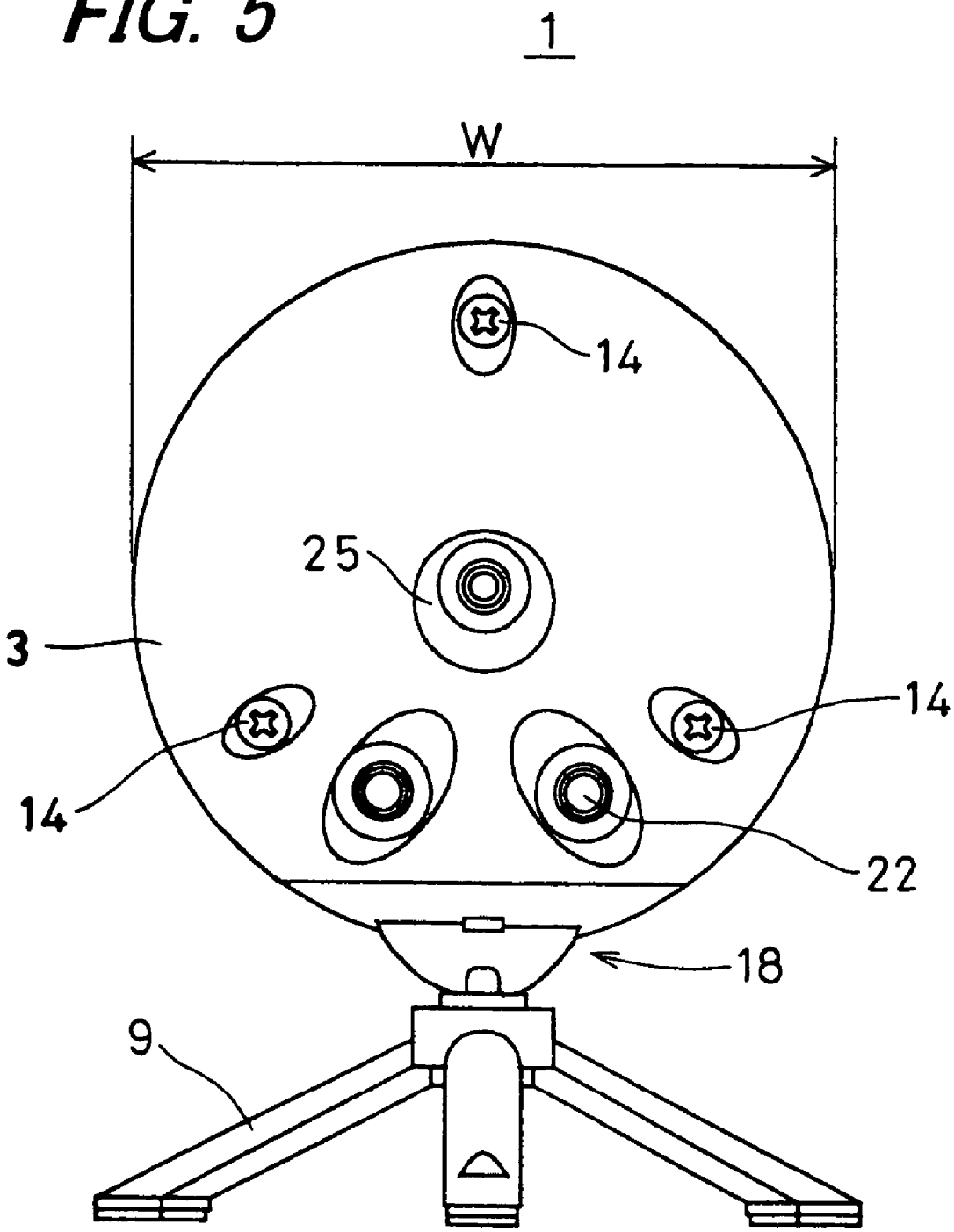
FIG. 5 is a back view of the speaker apparatus shown in FIG. 1.

Now referring to the drawings, preferred embodiments of the invention are described below.

FIG. 1 is a sectional side view showing a schematic structure of a speaker apparatus 1 according to a first embodiment of the invention. A speaker unit 2 executing electroacoustic conversion in the speaker apparatus 1 is contained in a speaker box 3 having an almost oval shape. The speaker box 3 can be divided into a baffle 4 as a first half portion and a box 5 as a second half portion, in the vicinity of a connecting portion 3*a*. An opening portion 4*a* is disposed to the baffle 4. A driving portion 6 of the speaker unit 2 is supported in a space inside the speaker box 3, and a sound radiation portion 7 of the speaker unit is connected to the opening portion 4*a* of the baffle 4 of the speaker box 3 via a cushioning material 8 such as felt or rubber. On a bottom portion of the speaker box 3, a pivotally supporting mechanism is disposed, and a stand 9 enabling the speaker box to swing is connected to the bottom portion.

Within the speaker box 3, on a back face side of the driving portion 6 of the speaker unit 2, a weight 10 is coupled. The weight 10 is provided with a main body portion 11 having mass enough to virtually act as a ground for acoustic vibrations, and a plurality of supports 12 serving as a supporting portion. The main body portion 11 has almost the same mass as that of the speaker unit 2, and functions as a ground anchor. The support 12 has a shape radially extending from the main body portion 11 toward the connecting portion 3*a* between the baffle 4 and the box 5 of the speaker box 3. At the connecting portion 3*a* between the baffle 4 and the box 5 of the speaker box 3, the respective supports 12 are sandwiched by cushioning materials 13 such as felt, and fixed by fixing members such as bolts 14, respectively. The speaker box 3 is formed by molding a synthetic resin material such as a foamed polypropylene (PP), for example.

At the bottom of one of the half portions of the speaker box 3, for example, at the bottom of the baffle 4, a hemispherical convex spherical body 15 is integrally formed. A sliding member 16 that has a concave spherical surface partially fitted with a convex spherical surface of the convex spherical body 15 and that can be displaced slidingly contacting the convex spherical body 15 is pressed to the convex spherical surface of the convex spherical body 15 by a shell member 17. The sliding member 16 is made of a metallic material such as iron. The shell member 17 is formed by die casting an aluminum material or the like. The shell member 17 has, as a nicked portion, a groove 17*a* for passing a coupling portion 16*a* extending outward in a radial direction from a surface of the sliding member 16. A front end of the coupling portion 16*a* is connected to the stand 9 that can be placed on a floor surface or the like. By placing the bottom portion of the stand 9 on a floor surface or the like, it is possible to cause the speaker box 3 to swing so as to change a direction thereof by a sliding displacement between the convex spherical body 15 and the sliding member 16 covered by the shell member 17, and the pivotally supporting mechanism 18 is composed of the convex spherical body 15, the sliding member 16 and the shell member 17. In the pivotally supporting mechanism 18, it is possible to fix a swing angle of the speaker box 3 on the stand 9, by fastening the shell member 17 by a bolt 18*a*.

The stand 9 of the embodiment is a supporting apparatus which pivotally supports the speaker apparatus 1 as a supporting object to be capable of swinging, and includes the convex spherical body 15, which is a convex spherical member disposed to a part of the speaker box 3 serving as a pivotally supporting portion of the speaker apparatus 1 in a state where a partial spherical surface protrudes, the sliding member 16, the shell member 17, and a leg portion 30. In the sliding member 16, a concave spherical surface partially fitted with the convex spherical body 15 is formed inward in the radial direction, a convex spherical surface is formed outward in the radial direction, and the concave spherical surface can be slidingly displaced along a convex spherical surface of the convex spherical body 15. The shell member 17 becomes a shell which covers the convex spherical body 15 via the sliding member 16, and has the groove 17*a* serving as the nicked portion which can guide in a manner that the sliding member 16 slides along the convex spherical body 15 and couple the convex spherical surface of the sliding member 16 to the outside. The leg portion 30 is a supporting member which is coupled to the sliding member 16 via the groove 17*a* of the shell member 17 and which supports the speaker apparatus 1 via the sliding member 16 and the convex spherical body 15.

The convex spherical body 15 is formed integrally with at least the baffle 4 of the speaker box 3, which is a part of the speaker apparatus 1 as the supporting object. Although it is possible to use a convex spherical member as a separate member, it is possible, by forming the convex spherical body 15 integrally with at least part of the speaker box 3, to reduce the number of components and facilitate the assembly of the pivotally supporting mechanism 18. It is also possible to form the convex spherical body 15 on the side of the box 5, which is the second half portion of the speaker box 3. Since forming the convex spherical body 15 on both the baffle 4 and the box 5 may cause a step and there is a possibility of blocking a smooth sliding displacement of the sliding member 16, forming integrally with either the baffle 4 or the box 5 is better for a smooth swinging operation.

The leg portion 30 serving as a supporting member is coupled to the sliding member 16 via the groove 17*a* of the shell member 17, and supports the speaker apparatus 1 via the sliding member 16 and the convex spherical body 15. Since the shell member 17 has the groove 17*a*, when the sliding member 16 coupled to the leg portion 30 via the groove 17*a* is slidingly displaced along the convex spherical body 15, a swing displacement of changing an angle formed by the leg portion 30 and the speaker apparatus 1 becomes possible. An angular displacement about an axial line is also possible at the coupling portion 16*a* for coupling the leg portion 30 and the sliding member 16, and it is possible to realize the pivotally supporting mechanism 18 that enables the speaker apparatus 1 to swing on the stand 9 by the swing displacement and the angular displacement. Since what is required is only to provide the speaker apparatus with the convex spherical body 15 with the partial sphere protruding, the capacity of the speaker box 3 is not decreased, and the amount of protrusion to the outside is reduced, whereby it is possible to miniaturize the shape required for pivotally supporting. The leg portion 30 has bottom portions capable of contacting a plane surface perpendicular to an axial line 9*a* of the stand 9 at a time.

A net 19 can be attached to and detached from the opening portion 4*a* of the baffle 4 of the speaker box 3, and by attaching the net 19, it is possible to protect, for example, a vibration board of the sound radiation portion 7 of the speaker unit 2 from being touched by a fingertip. Together with a rubber ring 20, the net 19 is inserted and fixed into an annular groove 4*b* disposed around the opening portion 4*a*, and it is possible to detach the net 19 by removing the rubber ring 20. A hole 21 is disposed on the back face side of the speaker box 3, and a terminal 22 for electrically driving the speaker unit 2 is attached.

The through hole 23 for inserting the bolt 14 is formed at each front end of a plurality of the supports 12. The inner diameter of each through hole 23 is larger than the outer diameter of a screw portion of the bolt 14, and the support 12 and the bolt 14 do not directly contact. As described later, the plurality of supports 12 are formed into different shapes. The weight 10 has a TOP indication 24 indicating an attachment direction. Here, it is also possible to dispose a bass reflex port 25 on the back face side of the speaker box 3, whereby it is possible to make the speaker box 3 work as a bass reflex type of cabinet. There is a case where the bass reflex port 25 is covered with a sound absorbing material 26. It is also possible, without disposing the bass reflex port 25 to the speaker box 3, to make the speaker box work as a hermetically sealing type of cabinet. It is also possible to put a sound absorbing material or the like into the speaker box 3.

FIGS. 2 to 5 show a side view, a front view, a back view and a plan view of the speaker apparatus 1 shown in FIG. 1, respectively. FIG. 1 corresponds to a sectional view taken on cutting line I-I of FIG. 3. It is assumed that a caliber of the sound radiation portion 7 of the speaker unit 2 contained in the speaker box 3 is approximately 70 mm, for example. A height H from the top of the speaker box 3 to the bottom of the stand 9 is approximately 160 mm, a depth D of the speaker box 3 including the net 19 is also approximately 160 mm, and a width W of the speaker box 3 is approximately 120 mm. The bolt 14 for fixing the front end of the support 12 is inserted deep into the hole 21 formed from the box 5 of the speaker unit 3 to the vicinity of the connecting portion to the baffle 4, and fastened by a hole disposed in the baffle 4 as a female screw. The terminal 22 for electrical connection to the speaker unit 2 is also disposed on the back face side of the box 5 of the speaker box 3.

As described above, in the speaker apparatus 1, the driving portion 6 of the speaker unit 2 is supported in the speaker box 3 that can be divided into the first half portion and the second half portion, and the sound radiation portion 7 of the speaker unit 2 is connected to the opening portion 4*a* of the baffle 4, which is the first half portion, of the speaker box 3 via the cushioning material 8. Vibrations of the speaker unit 2 itself caused by a reaction force when the speaker unit 2 makes acoustic output propagate to the surrounding air are damped by the cushioning material 8, and are hard to transmit to the speaker box 3. Within the speaker box 3, the driving portion 6 of the speaker unit 2 is coupled to the main body portion 11 of the weight 10. Since the main body portion 11 of the weight 10 has large mass enough to virtually act as a ground for acoustic vibrations, the acoustic impedance becomes sufficiently high as compared with air that the sound radiation portion 7 of the speaker unit 2 makes acoustic output propagate, and the weight hardly vibrates even when the weight is subject to a reaction force accompanying radiation of acoustic output to air.

Since the plurality of supports 12 having a radially extending shape extend from the main body portion 11 of the weight 10 toward the connecting portion 3*a* between the baffle 4 of the speaker box 3 and the box 5, which is the second half portion, and the bolts 14 fix the plurality of supports 12 at the connecting portion 3*a* of the speaker box 3, respectively, it is possible to support the weight 10 within the speaker box 3. The driving portion 6 of the speaker unit 2 is coupled to the main body portion 11 of the weight 10, and it is possible, by the main body portion 11 of the weight 10 acting as a virtual ground, to support the driving portion 6 of the speaker unit 2 within the speaker box 3 so that vibrations do not transmit. Even when using the stand 9 or the like in order to position the speaker box 3 away from a floor surface, a wall surface or the like of a room for executing sonic reproduction, it is not necessary to insert the stand 9 into the speaker box 3 to directly support the speaker unit 2, and it is possible to pivotally support the stand 9 and the speaker box 3 by the pivotally supporting mechanism 18, and cause the speaker box to swing.

Figure 6:
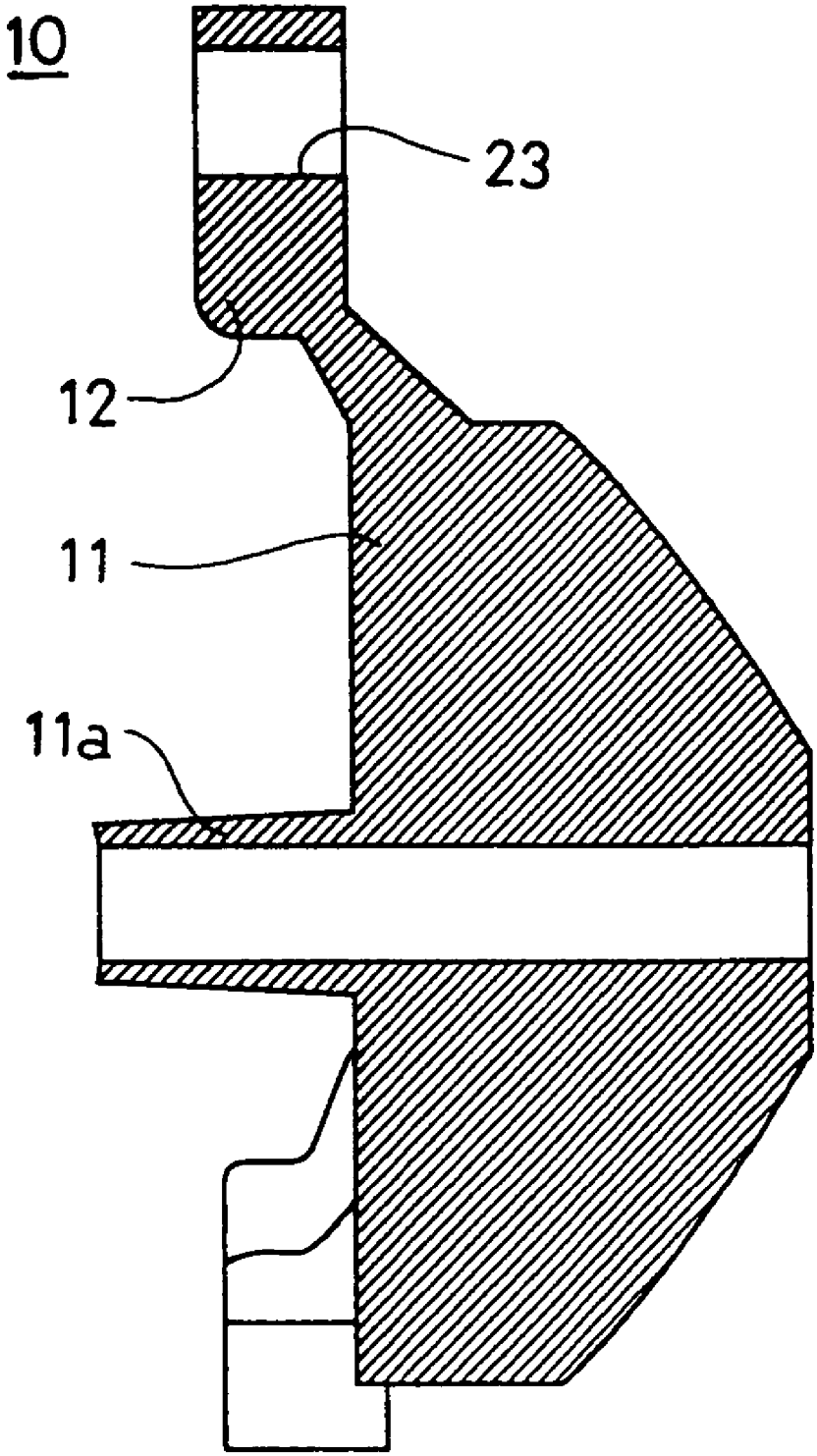
FIG. 6 is a sectional side view of a weight shown in FIG. 1.
Figure 7:
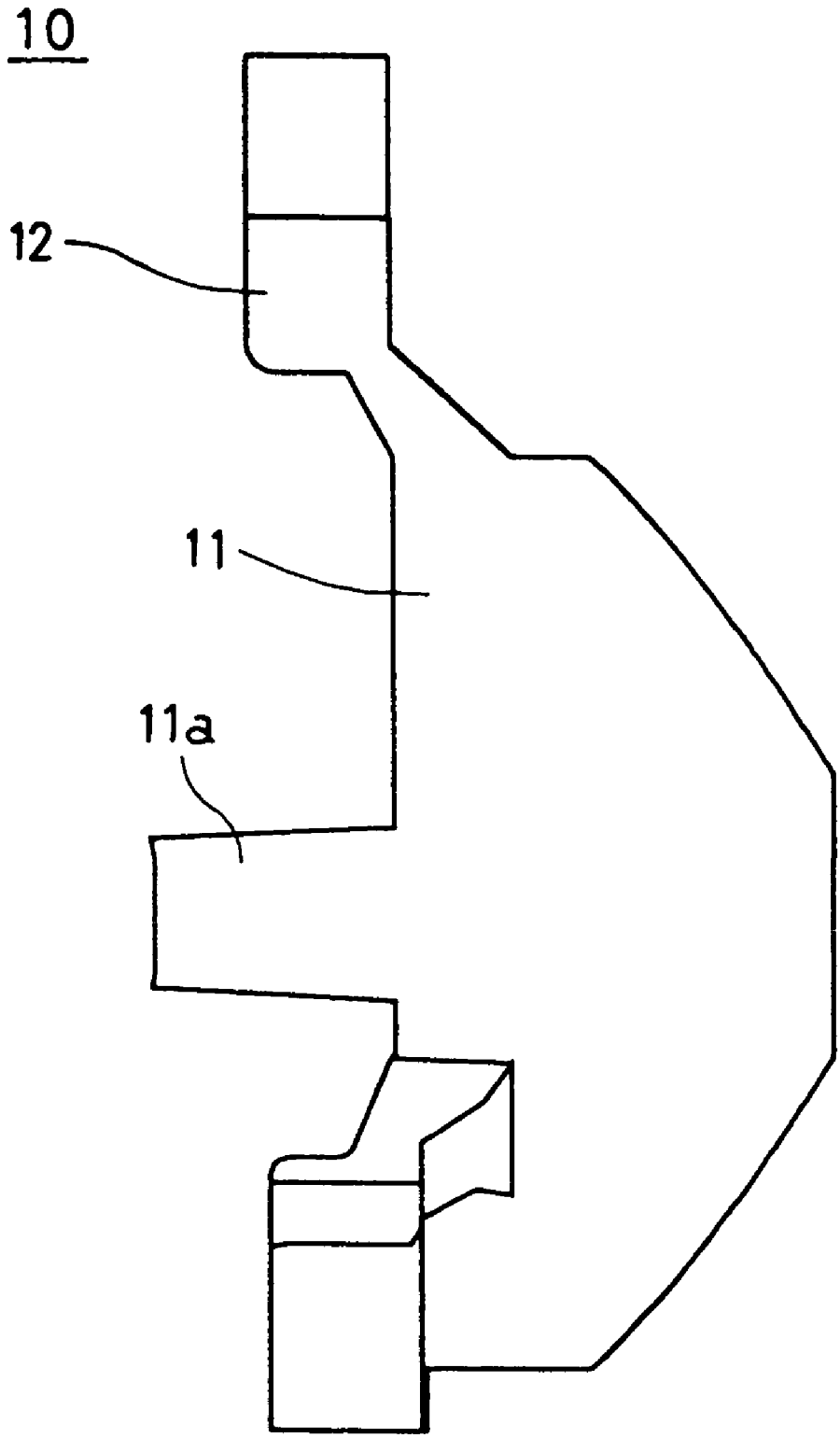
FIG. 7 is a side view of the weight shown in FIG. 6.
Figure 8:
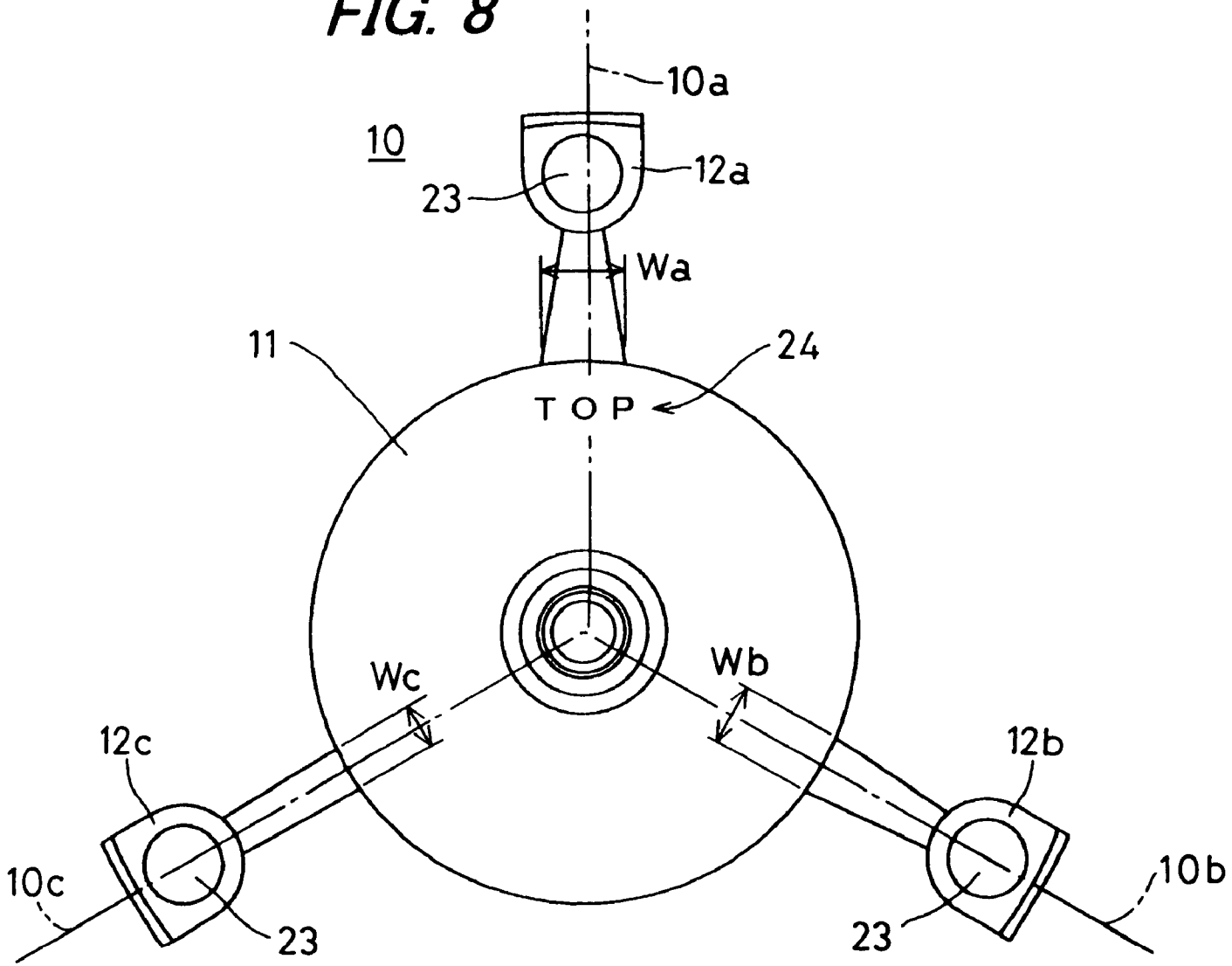
FIG. 8 is a front view of the weight shown in FIG. 6.

FIGS. 6 to 8 show a sectional side view, a side view and a front view of the weight 10 used in the speaker apparatus 1 shown in FIG. 1, respectively. The weight 10 is formed by, for example, die casting using zinc as a material, and has the main body portion 11 having large mass, and the plurality of, for example, three supports 12*a*, 12*b* and 12*c* serving as the supporting portion. The main body portion 11 has a substantially truncated core shape, and has a boss 11*a* protruding along an axial line in the center on the bottom face side. The boss 11*a* is coupled to the driving portion 6 of the speaker unit 2 as shown in FIG. 1. The three supports 12*a*, 12*b* and 12*c* protrude outward in the radial direction from an outer peripheral portion on the bottom face side, respectively, and central lines 10*a*, 10*b* and 10*c* of the respective supports 12*a*, 12*b* and 12*c* are placed so as to divide the bottom face of the main body portion 11 into three equal parts in the circumferential direction. The three supports 12*a*, 12*b* and 12*c* are formed in a manner that widths Wa, Wb and Wc of portions protruding in the radial direction from the bottom face of the main body portion 11 become mutually different.

As shown in FIG. 1, the through holes 23 for inserting and fixing the bolts 14 serving as fixing members are disposed to front ends of the supports 12*a*, 12*b* and 12*c*. As shown in FIG. 8, the shape of the through hole 23 and the periphery thereof is common in the three supports 12*a*, 12*b* and 12*c*, and only the widths Wa, Wb and Wc of the portions that the respective supports 12*a*, 12*b* and 12*c* protrude from the bottom face of the main body portion 11 are different. The center of the through hole 23 locates on the circumference of an approximately 45 mm radius from the center of the main body portion 11. In a case where the plurality of supports 12*a*, 12*b* and 12*c* have the same shape, resonance occurs in the same frequencies, and there is a possibility that the sound quality of reproduction sound as a speaker degrades due to the extra resonance.

In the weight 10 used in the speaker apparatus 1, the plurality of supports 12*a*, 12*b* and 12*c* have different shapes so as to make resonance frequencies thereof different. Since the plurality of supports 12*a*, 12*b* and 12*c* have mutually different shapes, the frequencies of vibrations that the supports 12*a*, 12*b* and 12*c* resonate are different from each other, whereby it is possible to prevent that vibrations increase in a specific frequency. Since, for example, the TOP indication 24 is disposed on the support 12*a* that should be fixed in the vicinity of the top of the speaker box 3 as an indication relating to the difference in shapes of the supports 12*a*, 12*b* and 12*c*, it is possible to prevent a mistake of a fixing direction of the weight 10 within the speaker box 3 at the time of an operation for assembling as the speaker apparatus 1 even when the difference in shapes is hard to visually confirm. For example, in the case of executing two-channel stereo reproduction by placing a pair of speaker apparatuses on the right and left, it is possible to prevent that the directions of the weights within the speaker apparatuses differ on the right and left.

As shown in FIG. 8, the plurality of supports 12*a*, 12*b* and 12*c* are formed to extend outward at equal intervals in the circumferential direction from the outer periphery of the main body portion 11. In the respective supports 12*a*, 12*b* and 12*c*, portions fixed by the bolts 14 at the correcting portion of the speaker box 3 have the same shape, and the widths Wa, Wb and Wc of the portions extending outward from the main body portion 11 are mutually different. It is possible to differentiate these widths by a value larger than variations of molding measurements, for example, by 0.5 mm, and set the width Wa of the support 12*a*, the width Wb of the support 12*b* and the width Wc of the support 12*c* to 7.4 mm, 6.9 mm and 6.4 mm, respectively. The degree of the difference is set to a few % to a dozen %. The supports 12*a*, 12*b* and 12*c* need to have a strength to support the heavy main body portion 11, and it is impossible to make as thin as the strength becomes short. Moreover, it is not preferable to make the supporting portions too thick because the capacity of the space within the speaker box 3 becomes small as the supports become thick. It is possible to set resonance frequencies so as to be different from each other by making the plurality of supports 12*a*, 12*b* and 12*c* have almost the same shape and extend outward from the main body portion 11 of the weight 10 at equal intervals in the circumferential direction, and differentiating the shapes of the portions extending outward from the main body portion 11. Since the front ends, which are the portions of the supports 12*a*, 12*b* and 12*c* fixed by the bolts 14 at the connecting portion between the baffle 4 of the first half portion and the box 5 of the second half portion of the speaker box 3, can be formed into the same shape, it is possible to use bolts of the same standards as the bolts 14.

Here, it is needless to say that the shapes of portions except the widths Wa, Wb and Wc in the supports 12*a*, 12*b* and 12*c* may be changed. Moreover, the dimensions and so on of the respective portions including the weight 10 of the speaker apparatus 1 can also be changed depending on the sizes of the speaker unit 2 and the speaker box 3 to be used. The number of the supports 12*a*, 12*b* and 12*c* can also be increased or decreased depending on the mass of the main body portion 11.

Figure 9:
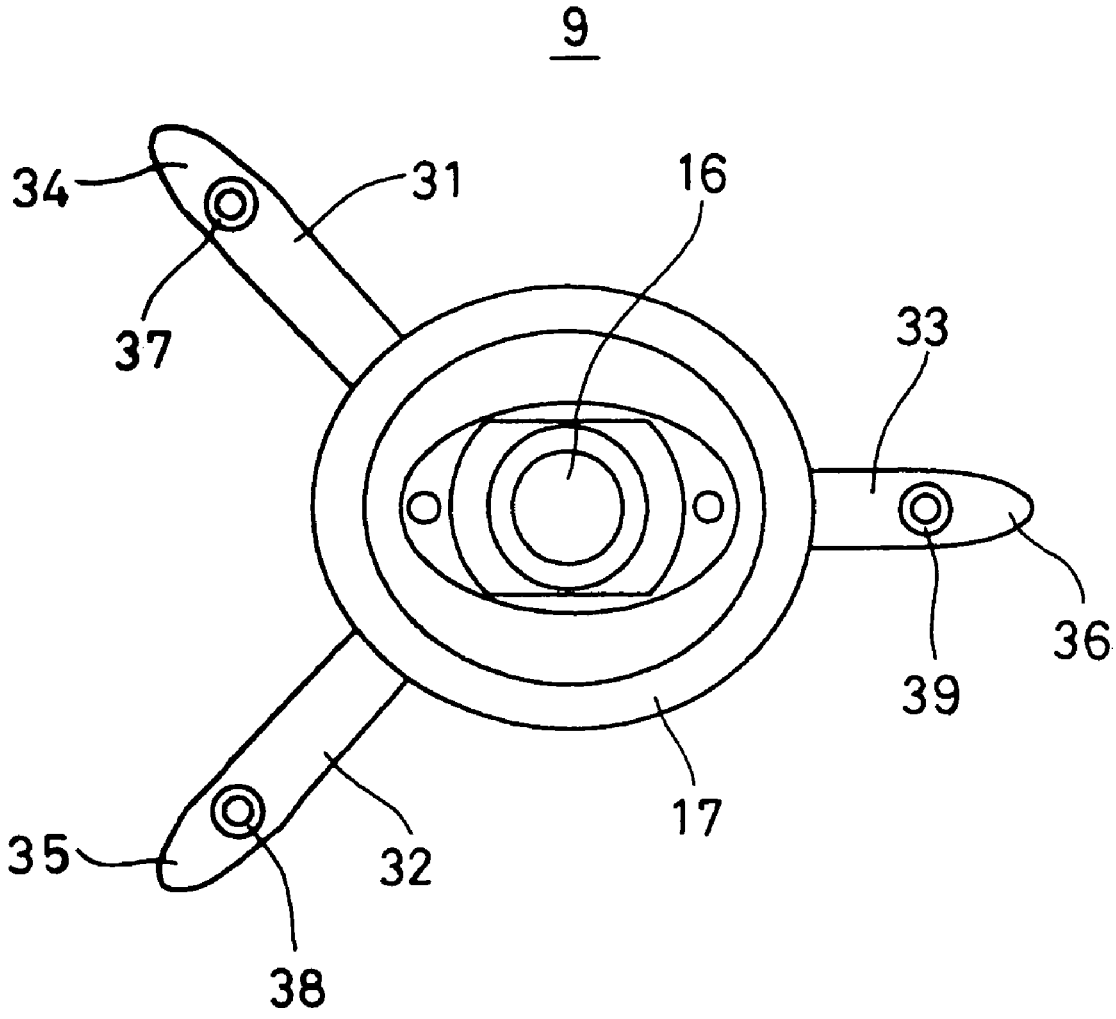
FIG. 9 is a plan view of a stand shown in FIG. 1.

FIG. 9 is a plan view showing a structure of the stand 9. The leg portion 30 of the stand 9 has three legs 31, 32 and 33 so as to become stable. The respective legs 31, 32 and 33 are placed in a manner that bottom portions 34, 35 and 36 of the front ends form an isosceles triangle. That is to say, the two legs 31 and 32 have equal lengths, and the one leg 33 is shorter than the others. This is because of consideration for design, and an angular displacement about an axial line is possible at the coupling portion 16*a* of the sliding member 16, so that the isosceles triangle formed by the bottom portions 34, 35 and 36 can be directed in any direction. The lengths of the three legs 31, 32 and 33 can be equalized so that the bottom portions 34, 35 and 36 form a regular triangle. Moreover, it is also possible to differentiate the lengths of all of the legs 31, 32 and 33. Through holes 37, 38 and 39 are disposed in the vicinities of the bottom portions 34, 35 and 36, respectively.

Figure 10:
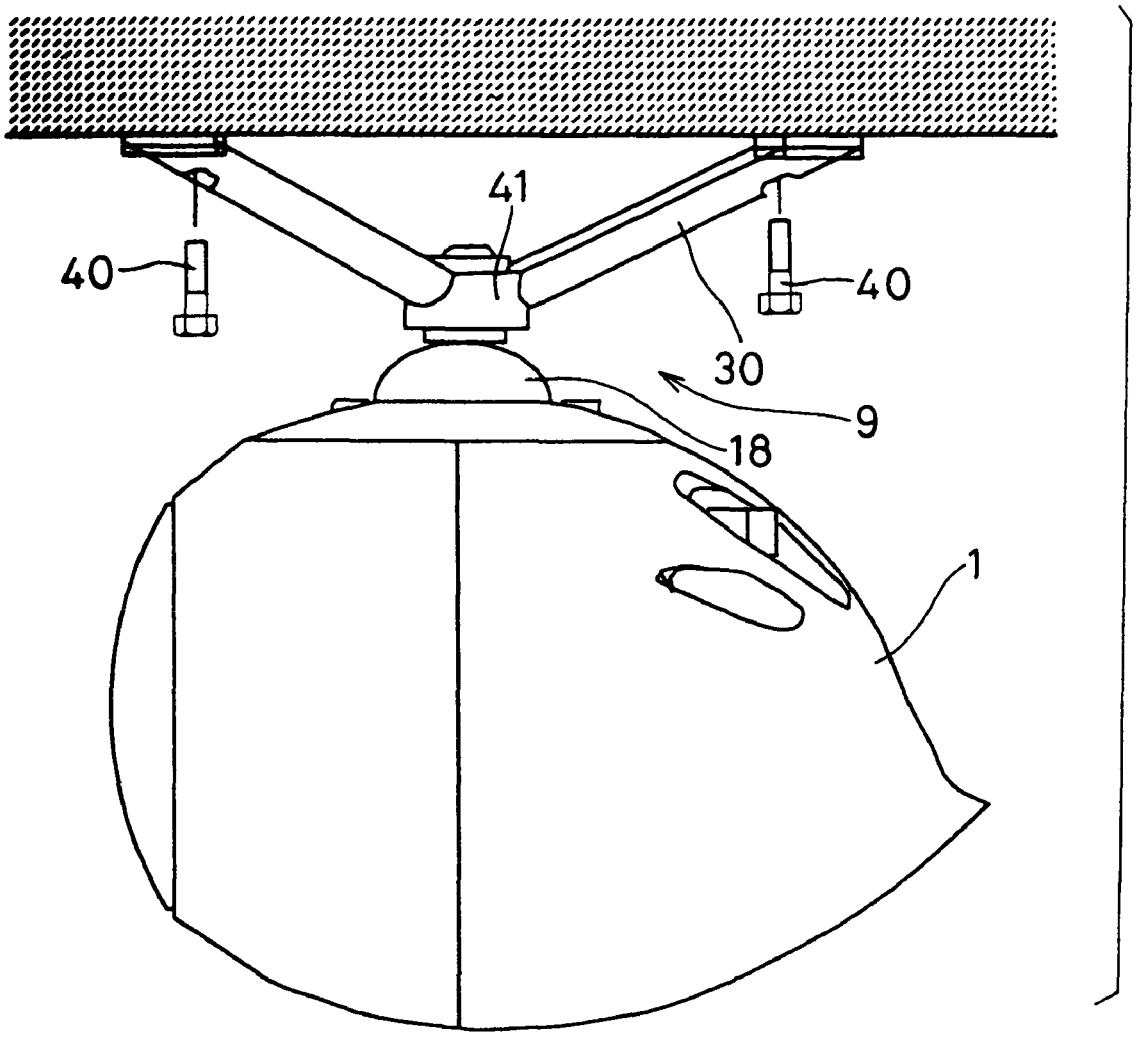
FIG. 10 is a side view showing a state where the speaker apparatus shown in FIG. 1 is attached to a ceiling.

FIG. 10 shows a state where the stand 9 is attached to a ceiling by the use of the through holes 37, 38 and 39 disposed to the legs 31, 32 and 33. By inserting bolts 40 or the like into the through holes 37, 38 and 39, it is possible to easily fix the stand 9 to a ceiling, a sidewall or the like. It is also possible to fix the stand 9 to a floor surface. However, in a case where the stand 9 is formed by zinc die cast or the like, there is empty weight, and the weight of the speaker apparatus 1 is heavy, so that the speaker apparatus 1 may be merely placed on a floor surface when used. There is a need to securely fix to a ceiling, a sidewall or the like by using the bolts 40 or the like.

The stand 9 includes a coupling portion 41 coupled to the sliding member 16, and the leg portion 30 having the plurality of legs 31, 32 and 33 that, as it is far from the coupling portion 41 along the direction of the predetermined axial line 9*a*, incline to be away from the axial line 9*a* in the radial direction. The front ends of the respective legs 31, 32 and 33 have the bottom portions 34, 35 and 36 that can be placed on a plane surface perpendicular to the axial line 9*a* at a time, and the through holes 37, 38 and 39 disposed in a direction parallel to the axial line 9*a* in the vicinities of the bottom portions 34, 35 and 36. When the bottom portions 34, 35 and 36 of the plural legs 31, 32 and 33 are placed on a floor surface, the axial line 9*a* becomes perpendicular to the floor surface, and the leg portion 30 of the stand 9 can support the supporting object such as the speaker apparatus 1 at the connecting portion 41 in the state of being away from the floor surface. Since the through holes 37, 38 and 39 are disposed in the vicinities of the bottom portions 34, 35 and 36 of the leg portion 30 in a direction parallel to the axial-line 9*a*, it is also possible to insert the bolts 40 or the like into the through holes 37, 38 and 39 and fix the leg portion 30. Besides, since it is possible to fix the leg portion 30 by using the through holes 37, 38 and 39, it is also possible to fix and support the supporting object to a ceiling, a sidewall or the like.

Figure 11:
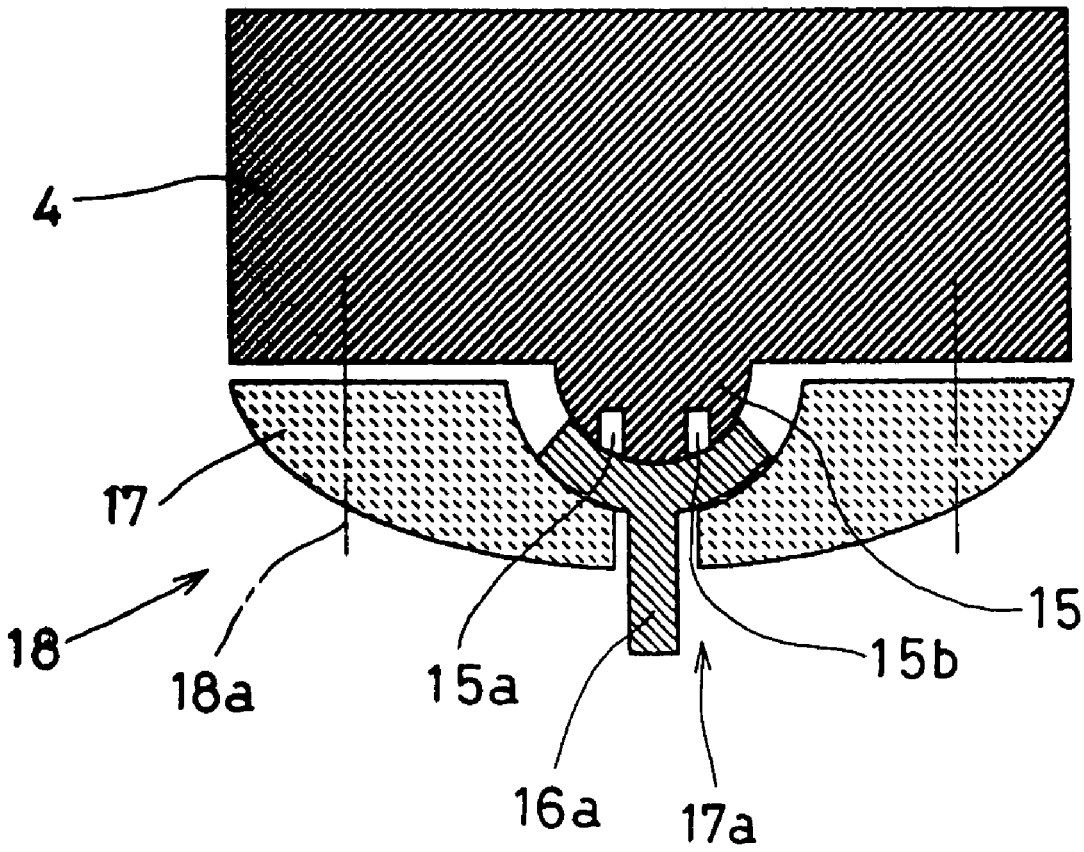
FIG. 11 is a sectional front view of a pivotally supporting mechanism shown in FIG. 1.

FIG. 11 shows a sectional structure of the pivotally supporting mechanism 18 of the embodiment. Because the convex spherical body 15 is molded integrally with the baffle 4 as described before, grooves 15*a* and 15*b* parallel to the groove 17*a* of the shell member 17 are formed away from the groove 17*a*. Since the groove 17*a* of the shell member 17 has a shape extending along the convex spherical body 15, when the coupling portion 16*a* between the sliding member 17 and the stand 9 is displaced along the groove 17*a*, a swing displacement of the stand 9 with respect to the supporting object becomes possible, and an angular displacement about an axial line of the coupling portion 16*a* also becomes possible. Since the convex spherical body 15 has the grooves 15*a* and 15*b* parallel to the groove 17*a* in positions away from the groove 17*a*, it is possible to avoid that the grooves 15*a* and 15*b* impair the smoothness of the sliding portion even when the stand 9 mares a swing displacement with respect to the supporting object. As a result of disposing the grooves 15*a* and 15*b* to the convex spherical body 15, it is possible to prevent a sink mark when forming the convex spherical body 15 by molding of a synthetic resin material, casting of a metallic material or the like, and it is possible to smooth a sliding surface.

Further, although the speaker apparatus 1 is used as the supporting object in the present embodiment, the invention can be applied to support of not only the speaker apparatus 1*a* but also another supporting object. For example, it is possible to apply the invention to support of various kinds of equipment such as an illuminator, an air conditioner and a video apparatus, and it is also possible to apply to simple support of a table.

Figure 12:
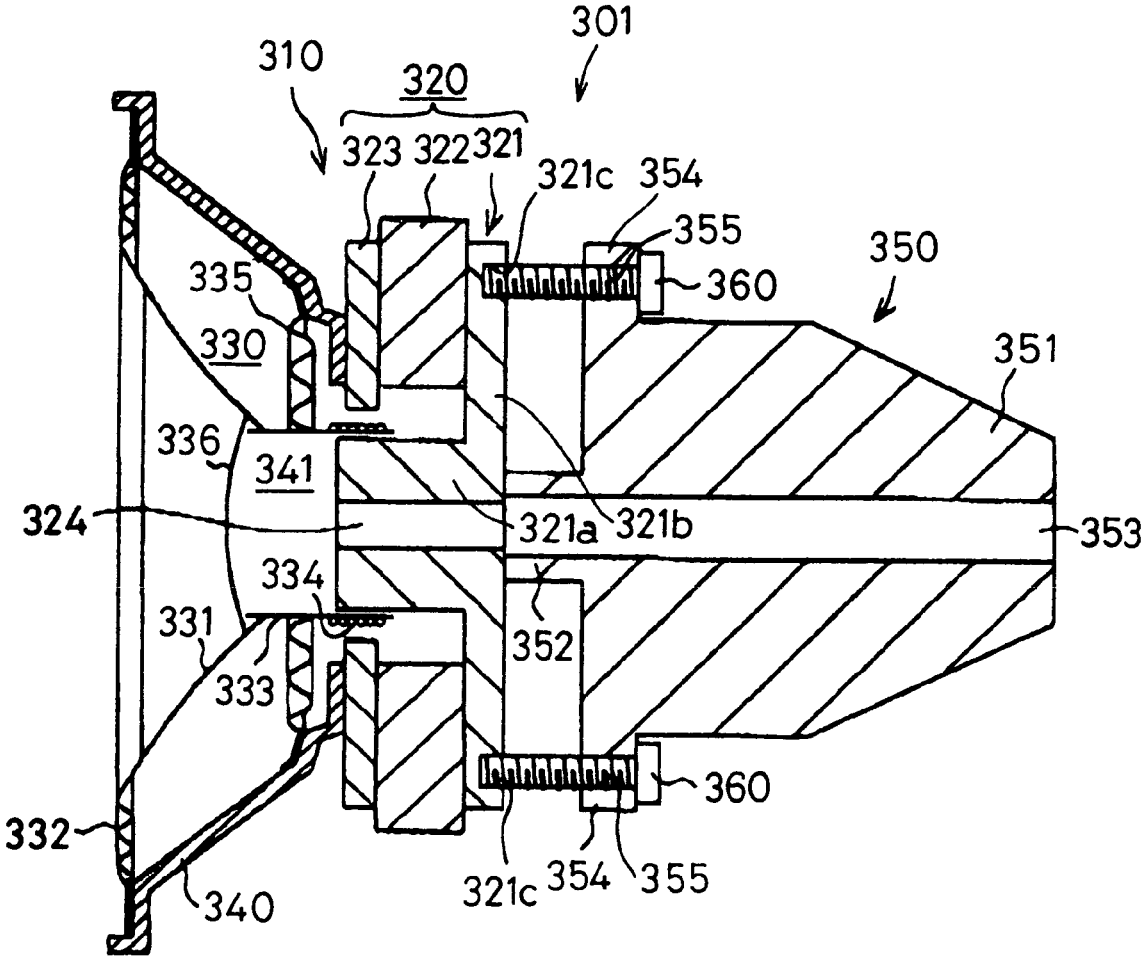
FIG. 12 is a sectional side view schematically showing a speaker structure according to a second embodiment of the invention.

FIG. 12 is a sectional side view schematically showing a speaker structure according to a second embodiment of the invention.

A speaker apparatus 301 comprises the speaker unit 310 and a weight 350 fixed on the back face side of the speaker unit 310.

The speaker unit 310 comprises a magnetic circuit portion 320, a vibrating portion 330 and a frame 340. The magnetic circuit portion 320 includes a yoke 321 made of a magnetic substance such as iron, an annular magnet 322 placed on a front face side of the yoke 321, and an annular top plate 323 placed on the front face side of the magnet 322. The yoke 321 is composed of a columnar center pole 321*a* and a back plate 321*b*, and a through hole 324 for air bleed is formed on the central axis of the center pole 321*a*. Moreover, on an outer peripheral portion of the back face of the back plate 321*b*, screw holes 321*c* for screwing front end portions of screw tools 360 for fixing the weight 350 together are formed at several places (about four places) at equal intervals.

The vibrating portion 330 includes a cone 331 having a substantially truncated cone shape, an edge 332 adhered and fixed to one end on a front face side of the cone 331, a cylindrical voice coil bobbin 333 adhered and fixed to another end on a rear side of the cone 331, a voice coil 334 wound around an outer periphery of the voice coil bobbin 333, an annular damper 335 adhered and fixed to the voice coil bobbin 333 and the frame 340, a center cap 336 for capping a central portion of the cone 331, and the like.

The frame 340 is a member for fixing the magnetic circuit portion 320 and the vibrating portion 330, and is formed into a substantially truncated cone shape. A front opening portion of the frame 340 is adhered and fixed to the cone 331 via the edge 332. A rear portion of the frame 34C is adhered and fixed to the top plate 323 of the magnet c circuit portion 320. A hole (not shown) for regulating back pressure of the cone 331 is formed in a designated place on the sidewall surface of the frame 340.

The weight 350 includes a main body portion 351 made of metal having a substantially truncated cone shape, and a screwing portion 354 extending in the radial direction from an outer peripheral portion of the front face of the main body portion 351. The front face of the weight 350 except a protruding portion 352 in the center is formed by a plane surface. That is, the front face of the main body portion 351 is formed in a flat surface. The protruding portion 352 is formed so as to protrude from the center portion of the front face of the main body portion 351 toward the front face side, along the central axis of the main body portion 351. In the main body portion 351 and the protruding portion 352, a through hole 53 for air bleed having a diameter almost the same as, preferably slightly larger than, the through hole 324 is formed along the central axis of the main body portion 351. On the screwing portion 354, a screw hole 355 for inserting the screw tool 360 for fixing the weight 350 and the speaker unit 310 is formed in a position facing the screw-hole 321*c*.

The speaker unit 310 and the weight 350 are combined in the following manner. That is, the weight 350 is placed on the back face side of the speaker unit 310, and the protruding portion 352 is positioned in a manner that the through hole 324 formed in the center pole 321*a* and the through hole 353 of the weight 350 communicate with each other. In addition, the screw tools 360 is inserted from the back face side into the screw holes 355 disposed at several places on the screwing portion 354 of the weight 350, and the front end portions of the screw tools 360 is screwed into the respective screw holes 321*c* of the speaker unit 310.

Then, the assembled speaker apparatus 301 is installed in a speaker cabinet having a specified shape. For example, the speaker apparatus is installed in the speaker cabinet by fixing the front face of the frame 340 of the speaker apparatus 301 to an opening of the cabinet. Alternatively, the speaker apparatus may be installed by supporting the weight 350 within the cabinet in a case where the weight 350 is heavy.

Next, an operation of the speaker unit 310 will be described.

When the voice coil 334 of the speaker unit 310 is energized, a driving force acts on the voice coil 334 in a magnetic gap, the cone 331 transforms, and sound waves are radiated from the cone 331 to the surroundings. At this moment, the voice coil 334 generates heat, and the heat is radiated from a gap between the top plate 323 and the center pole 321*a* to the interior space 341 of the speaker unit 310, and transmitted to the respective members such as the yoke 321.

The high-temperature air radiated into the interior space 341 is discharged from the interior space 341 to the outside on the back face side via the through hole 324 and the through hole 353 when the cone 331 is pressed backward. The outside air is sucked into the interior space 341 from the outside on the back face side via the through hole 353 and the through hole 324 when the cone 331 is drawn back forward, with the result that the cooling efficiency of the yoke 321 is increased by the air sucked from the outside.

Besides, since the heavy weight 350 is fixed on the back face side of the magnetic circuit portion 320, even if a reaction force occurring when sound waves are radiated from the cone 331 to the surrounding air transmits to the magnetic circuit portion 320, the weight 350 works as a virtual ground, with the result that a firm footing is formed, vibrations are suppressed, and an amplitude operation of the cone is executed faithfully to audio signals.

In accordance with the speaker structure according to the second embodiment of the invention, the weight 350 is attached to the speaker unit 310 in a state where the through hole 324 and the through hole 353 communicate with each other, so that it is possible to discharge the high-temperature air from the interior space 341 of the speaker unit 310 to the outside via the through hole 324 and the through hole 353, and suck the outside air into the interior space 341 of the speaker unit 310 from the outside via the through hole 353 and the through hole 324. Therefore, it is possible to obtain an effect of cooling the magnetic circuit portion 320 by suck and discharge of the air, and an effect of reducing a back pressure load acting on the cone 331 of the speaker unit 310 and linearly causing the cone 331 to execute the amplitude operation with respect to audio signals, that is, an effect by air bleed. Moreover, since the weight 350 works as a virtual ground, it is possible to suppress vibrations of the speaker unit 310 and cause the cone 331 to efficiently output sound waves, so that it is possible to increase an acoustic characteristics, and it is also possible to obtain the effect by the weight 350 simultaneously.

Figure 13:
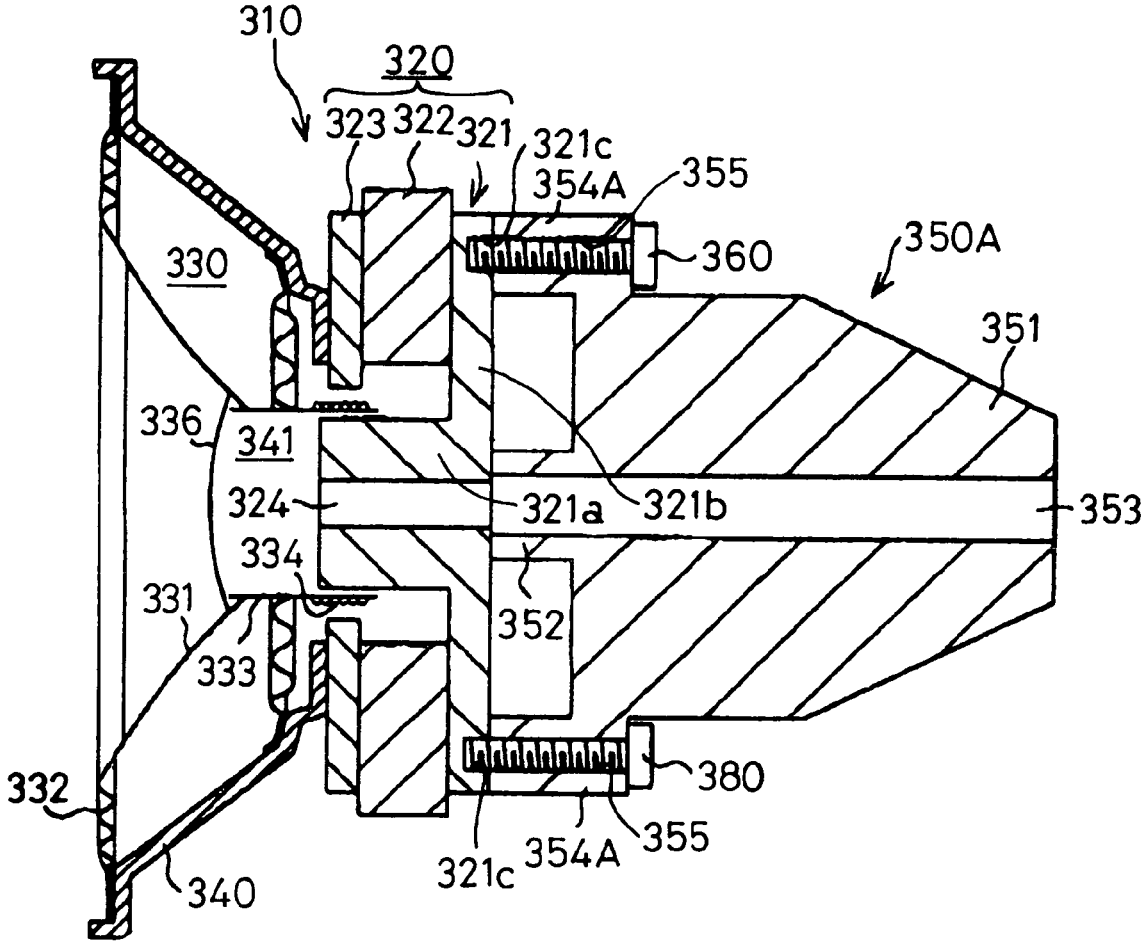
FIG. 13 is a sectional side view schematically showing a speaker structure according to a third embodiment of the invention.

Although, in the speaker structure according to the second embodiment of the invention, the weight 350 is fixed to the speaker unit 310 by the screw tool 360 in a position where the protruding portion 352 of the weight 350 abuts against the back face of the magnetic circuit portion 320 (the yoke 321), a speaker structure can be configured as shown in FIG. 13 in a third embodiment of the invention.

In the speaker structure shown in FIG. 13, a screwing portion 354A of a weight 350A extends on the front face side to a position coincident with an end surface of the protruding portion 352, so that it is possible to screw in a manner that the back face of the yoke 321 and the front face of the screwing portion 354A are joined. By coupling the screw hole 321*c* and the screw hole 355 in this manner, it is possible to more firmly fix the weight 350A to the speaker unit 310. A though a screw thread is cut in the screw hole 355, the screw hole may be a hole without a screw thread cut.

Figure 14:
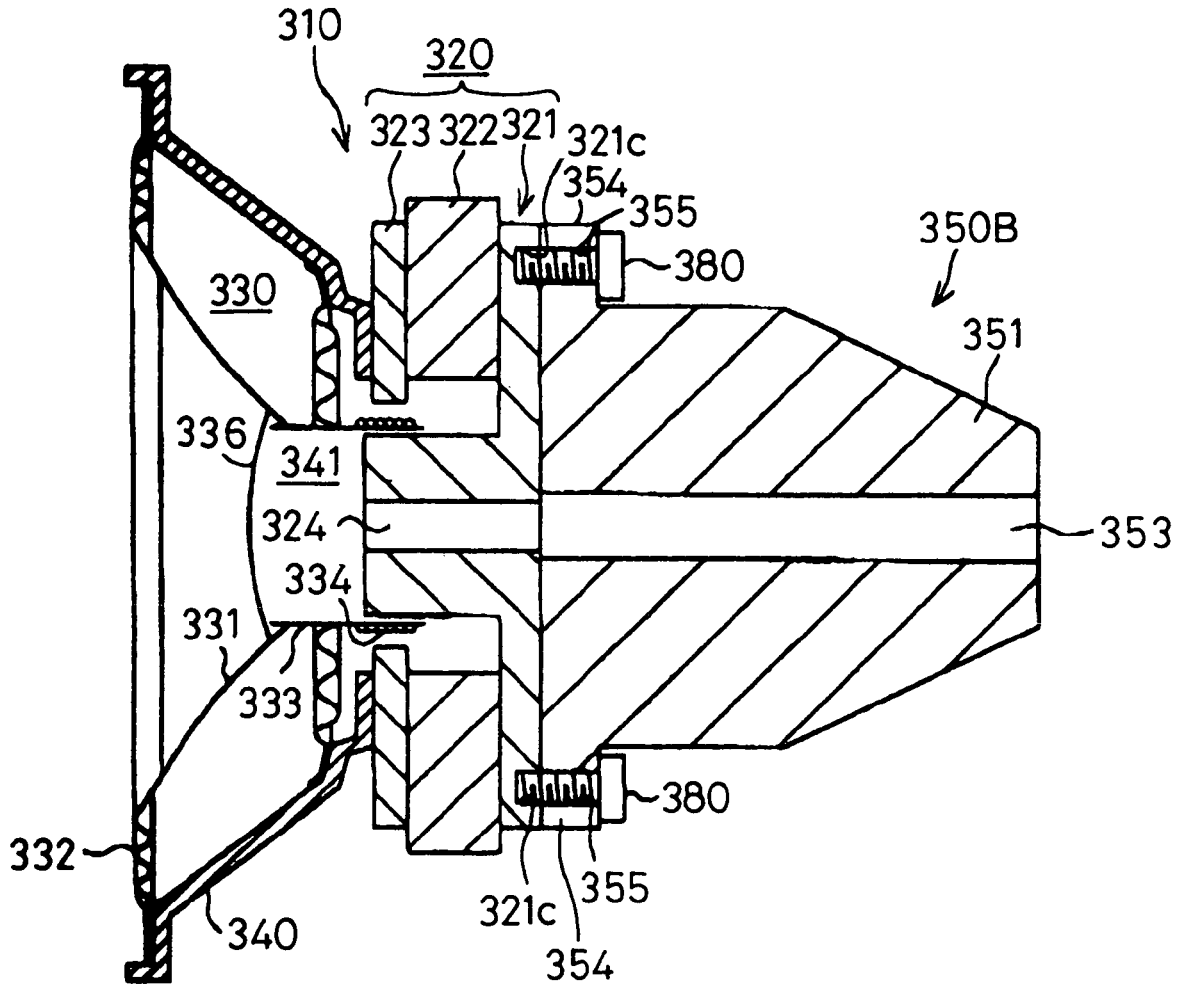
FIG. 14 is a sectional side view schematically showing a speaker structure according to a fourth embodiment of the invention.

Further, in a forth embodiment of the invention, a speaker structure can be configured as shown in FIG. 14. In the speaker structure shown in FIG. 14, the front face of a weight 350B is formed by a flat surface, that is, the protruding portion 352 of the weight 350 shown in FIG. 12 is not disposed, and the back face of the yoke 321 and the front face of the weight 350B are directly joined in a state where the through hole 324 and the through hole 353 communicate with each other. According to the structure, it is possible to make a heat transmission surface large, and it is possible to efficiently radiate heat of the magnetic circuit portion 320 through an end surface of the weight 350B. In this case, in order to prevent a change in intensity of a magnetic field of the magnetic circuit portion 320, it is preferable to form the weight 350B by nonmagnetic metal. A material for preventing the change in intensity of the magnetic field may be interposed between the back face of the yoke 321 and the front face of the weight 350B.

Figure 15:
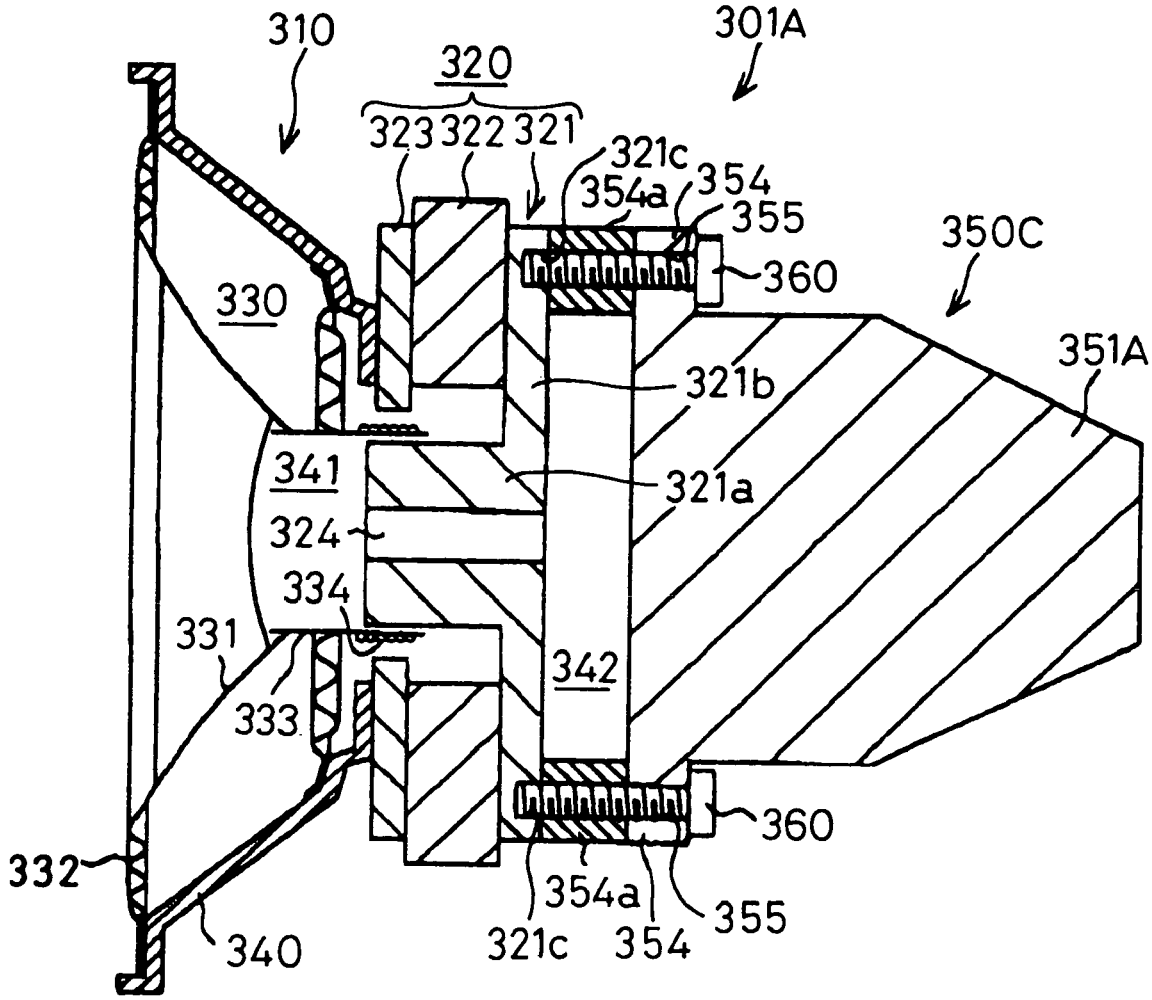
FIG. 15 is a sectional side view schematically showing a speaker structure according to a fifth embodiment of the invention.

FIG. 15 is a sectional side view schematically showing a speaker structure according to a fifth embodiment of the invention. Since components of the speaker structure according to the embodiment except a weight are the same as those of the speaker structure shown in FIG. 12, the weight will be denoted by different reference numeral 350C, and the other components having the same functions will be denoted by the same reference numerals and a description thereof will be omitted.

The speaker structure according to the fifth embodiment of the invention is different from the speaker structure according to the second embodiment of the invention with respect to the following points. That is, in the speaker structure according to the second embodiment of the invention, the weight 350 is attached to the speaker unit 310 in a state where the through hole 324 and the through hole 353 communicate with each other. On the other hand, in the speaker structure according to the fifth embodiment of the invention, a through hole is not formed in the weight 350C, and the weight 350C is attached to the speaker unit 310 in a state where a gap 342 is disposed between the back face of the speaker unit 310 and the front face of the weight 350C. In the following, only a point of difference will be described.

A speaker apparatus 301A comprises the speaker unit 310 and the weight 350C fixed on the back face side of the speaker unit 310.

The weight 350C includes a main body portion 351A made of metal having a substantially truncated cone shape, and the screwing portion 354 extending in the radial direction from an outer peripheral portion of the front face of the main body portion 351A. The front face of the weight 350C is formed by a flat surface.

On the screwing portion 354, the screw hole 355 for inserting the screw tool 360 for fixing the weight 350C and the speaker unit 310 is formed in a position facing the screw hole 321*c* formed in the yoke 321. Moreover, on the front face side of the screw hole 55, a cylindrical spacer 354*a* having a through hole of almost the same diameter as the screw hole 355 is placed.

The speaker unit 310 and the weight 350C are combined in the following manner. That is, firstly, the weight 350C is placed on the back face side of the speaker unit 310 in a state where the spacer 354*a* for defining the gap 342 is interposed. Then, the screw tools 360 are inserted from the back face side into the screw holes 355 disposed in several places on the screwing portion 354 of the weight 350C, and the front ends of the screw tools 360 are screwed into the respective screw holes 321*c* of the yoke 321.

The high-temperature air radiated into the interior space 341 when the speaker unit 310 is driven is discharged from the interior space 341 to the outside on the side face side of the magnetic circuit portion 320 via the through hole 324 and the gap 342 when the cone 331 is pressed backward. The outside air is sucked into the interior space 341 from the outside on the side face side of the magnetic circuit portion 320 via the gap 342 and the through hole 324 when the cone 331 is drawn back forward, with the result that the cooling efficiency of the yoke 321 is increased by the air from the outside.

Besides, since the heavy weight 350C is fixed on the back face side of the magnetic circuit portion 320, even if a reaction force occurring when sound waves are radiated from the cone 331 to the surrounding air transmits to the magnetic circuit portion 320, the weight 350C works as a virtual ground, with the result that a firm footing is formed, vibrations are suppressed, and an amplitude operation of the cone 331 is executed faithfully to audio signals.

In accordance with the speaker structure according to the fifth embodiment of the invention, the weight 350C is attached to the speaker unit 310 by the screw tool 360 in a state where the gap 342 is disposed, so that it is possible to make the interior space 341 of the speaker unit 310 and the outside communicate with each other via the through hole 324 and the gap 342, and it is possible to obtain both the effect by air bleed and the effect by the weight 350C as in the speaker structure according to the fifth embodiment of the invention.

Figure 16:
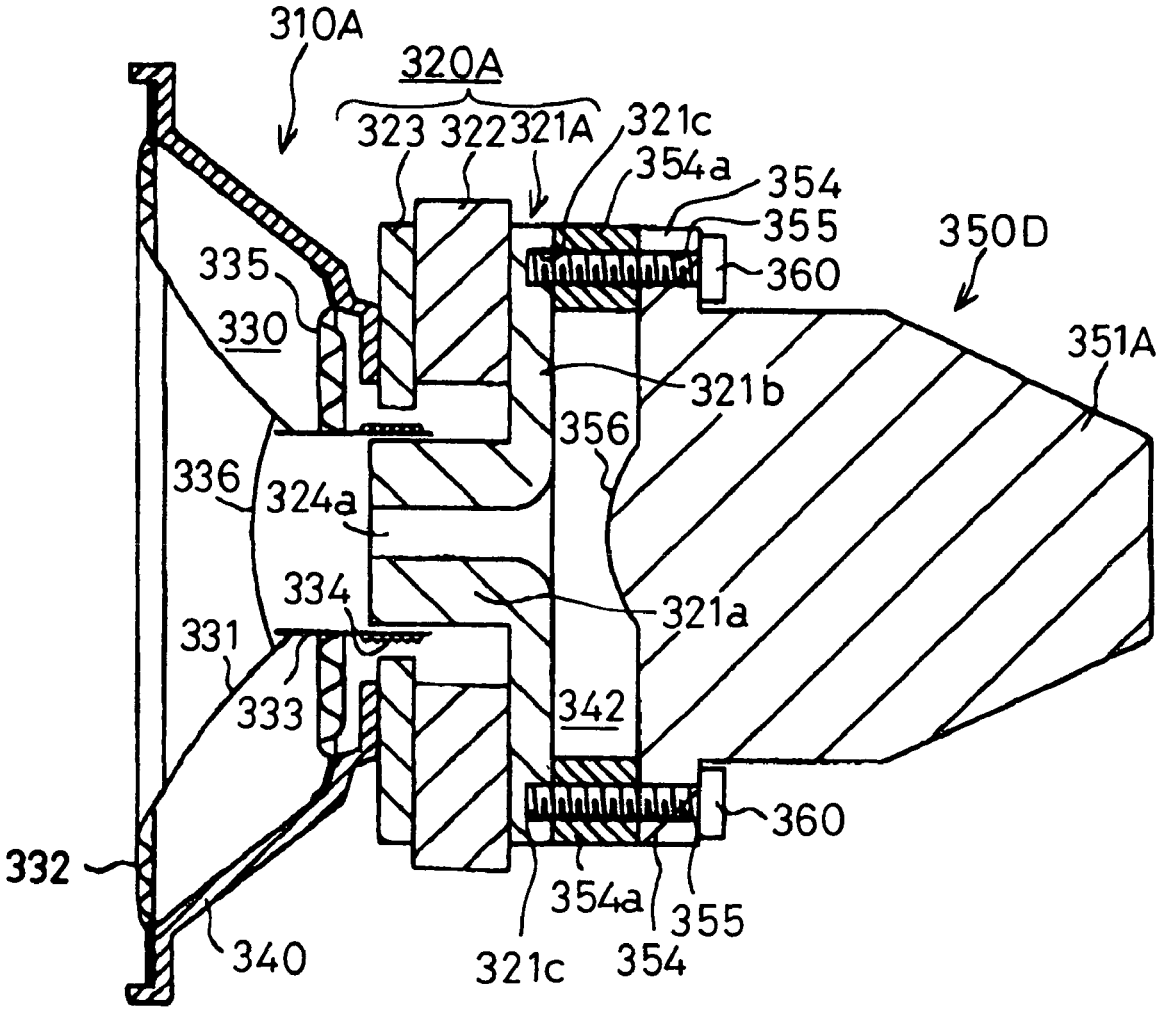
FIG. 16 is a sectional side view schematically showing a speaker structure according to a sixth embodiment of the invention.

The front face of the weight 350C is formed by the flat surface in the speaker structure according to the fifth embodiment of the invention. On the other hand, a structure in the sixth embodiment of the invention may be configured as shown in FIG. 16. That is, a speaker unit 310A in which a through hole opening of a through hole 324*a* formed on the back face of a yoke 321A is processed into a tapered shape and a weight 350D provided with a convex portion 356 having a curved surface in the center of the front face are attached to each other by the screw tool 360 in a state where the gap 342 is disposed.

According to the speaker structure, it is possible to reduce the resistance of air discharged from the through hole 324*a* and the resistance of air sucked into the through hole 324*a*, by the through hole 324*a* of which opening is processed into a tapered shape and the convex portion 356 (air flow smoothing means), and it is possible to further increase the effect by air bleed.

Further, although the yoke 321A is attached to the weight 350C in a state where the spacer 354*a* is interposed in the speaker structure according to the fifth embodiment of the invention, in another embodiment of the invention, the yoke 321A may be attached to the weight 350C only by the screw tool 360 without interposing the spacer 354*a*.

Figure 17A:
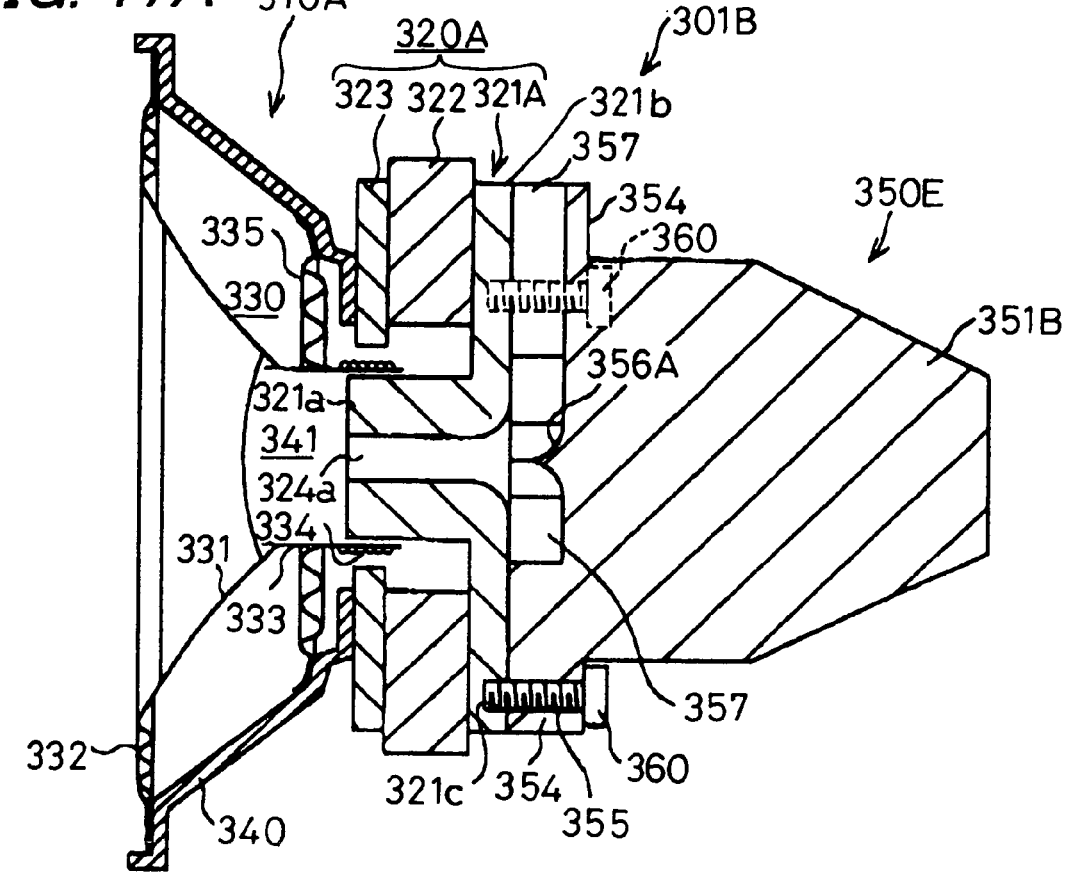
FIGS. 17A and 17B are views schematically showing a speaker structure according to a seventh embodiment of the invention.
Figure 17B:
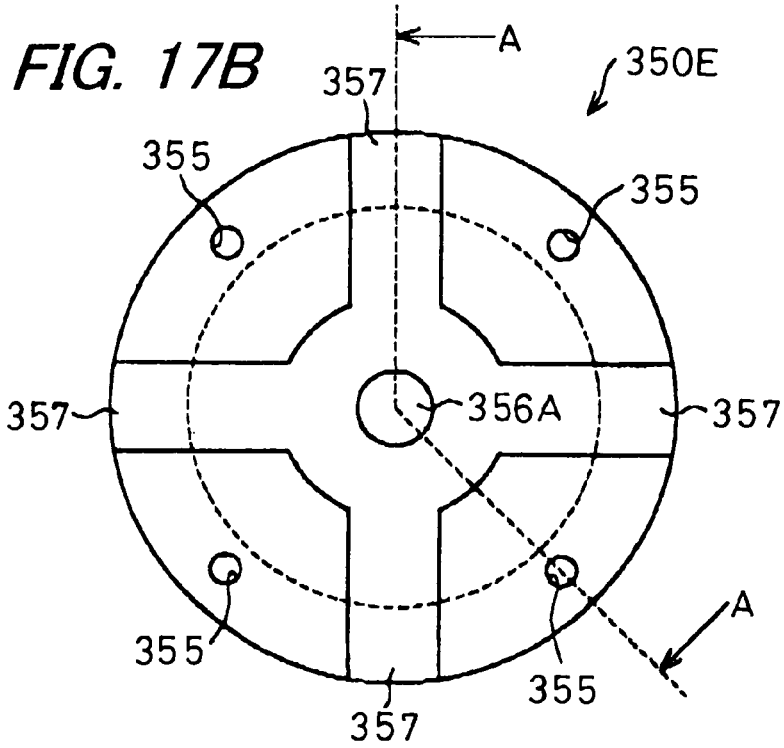

FIGS. 17A and 17B are views schematically showing a speaker structure according to a seventh embodiment of the invention, FIG. 17A is a sectional side view taken on line A-A in FIG. 17B, and FIG. 17B is a front view of a weight 350E. Since components of the speaker structure according to the embodiment except a weight are almost the same as those of the speaker structure shown in FIG. 15, the weight will be denoted by different reference numeral 350E, and the other components having the same functions will be denoted by the same reference numerals and a description thereof will be omitted.

The speaker structure according to the seventh embodiment of the invention is different from the speaker structure according to the fifth embodiment of the invention with respect to the following points. That is, in the speaker structure according to the fifth embodiment of the invention, the speaker unit 310 and the weight 350C are fixed in a state where the gap 342 is disposed between the back face of the speaker unit 310 and the front face of the weight 350C. On the other hand, in the speaker structure according to the seventh embodiment of the invention, the weight 350E with a groove portion 357 formed on a surface facing the back face of the speaker unit 310A is joined to the speaker unit 310A. In the following, only a point of difference will be described.

A speaker apparatus 301B comprises the speaker unit 310A and the weight 350E joined to the back face of the speaker unit 310A.

The weight 350E includes a main body portion 351B made of nonmagnetic metal having a substantially truncated cone shape, and the screwing portion 354 extending in the radial direction from an outer peripheral portion of the front face of the main body portion 351B. The concave groove portion 357 that a specified regional face in the center has a circular shape and that extends from the circumference thereof to a position of the outer periphery of the screwing portion 354 is formed on the front face side of the weight 350E. A convex portion 356A having a substantially cone shape is formed in a central portion where the groove portion 357 is formed.

On the screwing portion 354, the screw hole 355 for inserting the screw tool 360 for tightly fixing the speaker unit 310A and the weight 350E is formed in a position facing the screw hole 321*c* formed in the yoke 321A.

the speaker unit 310A and the weight 350E are combined in the following manner. That is, firstly, the weight 350E is placed on the back face side of the speaker unit 310A in a manner that the screw hole 321*c* and the screw hole 355 overlie each other. Then, the screw tools 360 are inserted into the screw holes 355 disposed in several places on the weight 350E from the back face side, and the front end portions of the screw tools 360 are screwed into the respective screw holes 321*c* of the speaker unit 310A, whereby the combination is completed.

The high-temperature air radiated into the interior space 341 when the speaker unit 310A is driven is discharged from the interior space 341 to the outside on the side face side of a magnetic circuit portion 320A via a through hole 324*a* whose back face of the through hole opening is processed into a tapered shape and the groove portion 357 when the cone 331 is pressed backward. The outside air is sucked into the interior space 341 from the outside on the side face side of the magnetic circuit portion 320A via the groove portion 357 and the through hole 324*a* when the cone 331 is drawn back forward, with the result that the cooling efficiency of a yoke 321A is increased by the air from the outside.

Besides, since the heavy weight 350E is fixed on the back face side of the magnetic circuit portion 320A, even if a reaction force occurring when sound waves are radiated from the cone 331 to the surrounding air transmits to the magnetic circuit portion 320A, the weight 350E works as a virtual ground, with the result that a firm footing is formed, vibrations are suppressed, and an amplitude operation of the cone 331 is executed faithfully to audio signals.

Figure 18A:
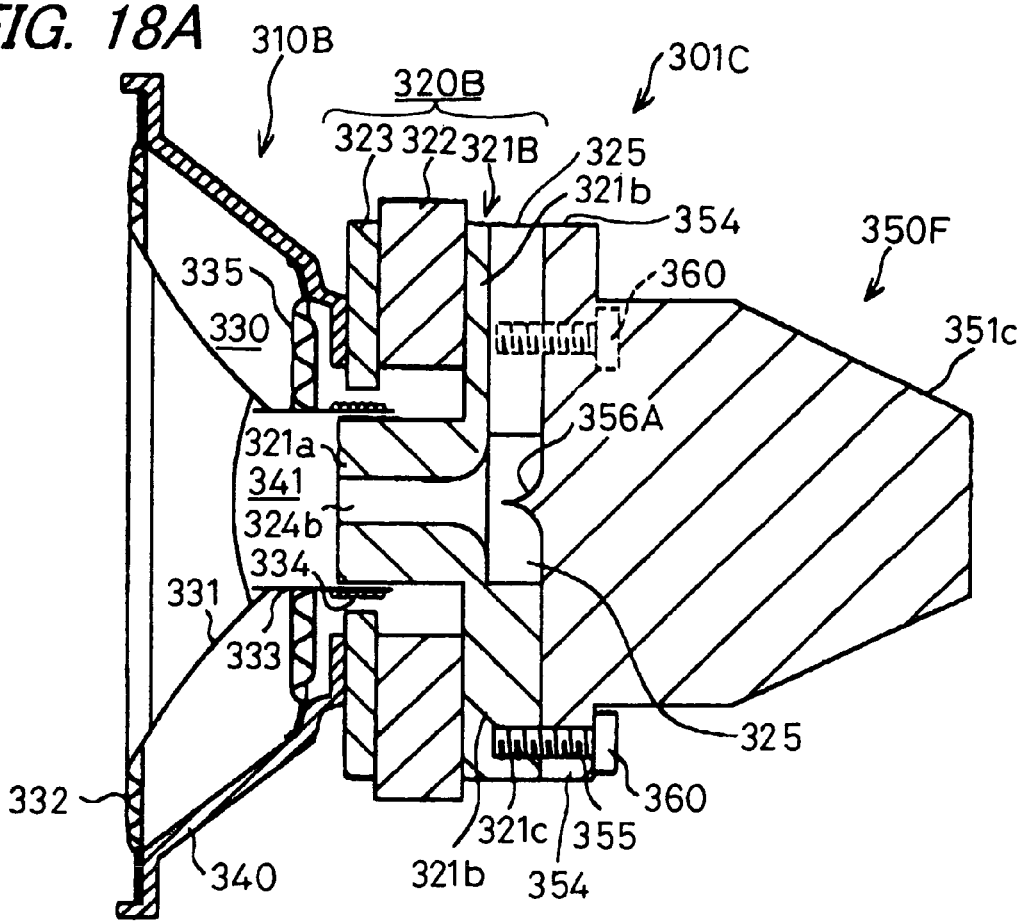
FIGS. 18A and 18B are views schematically showing a speaker structure according to an eighth embodiment of the invention.
Figure 18B:
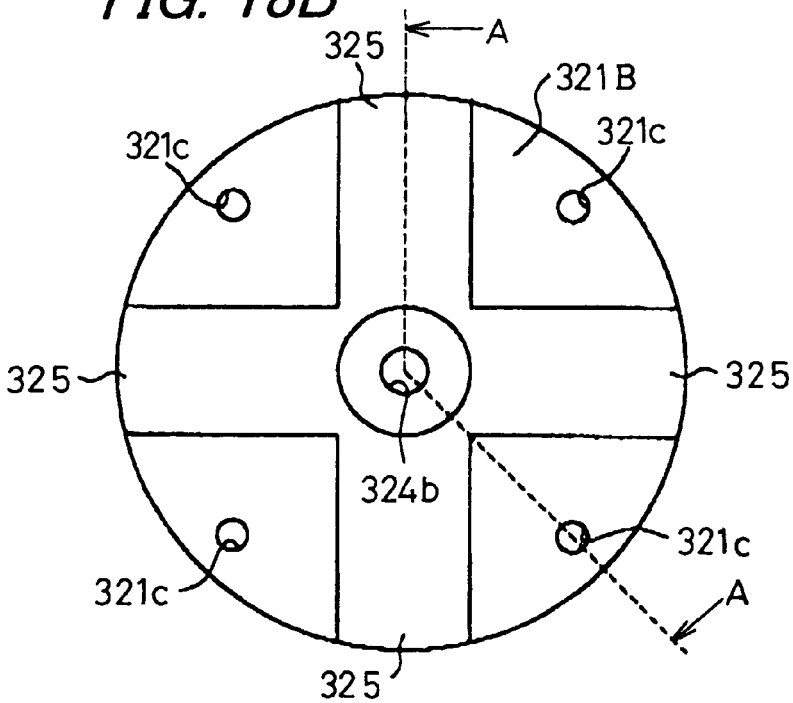

In accordance with the speaker structure according to the seventh embodiment of the invention, it is possible to make the interior space 341 of the speaker unit 310A and the outside on the side face side of the magnetic circuit portion 320A communicate with each other via the through hole 324*a* and the groove portion 357, and it is possible to obtain both the effect by air bleed and the effect by the weight 350E as in the speaker structure according to the second embodiment of the invention, FIGS. 18A and 18B are views schematically showing a speaker structure according to an eighth embodiment of the invention, FIG. 18A is a sectional side view taken on line A-A in FIG. 185, and FIG. 18B is a back view of a magnetic circuit portion 320B. Since components of the speaker structure according to the embodiment except a magnetic circuit portion and a weight are almost the same as those of the speaker structure shown in FIG. 15, the magnetic circuit portion and the weight having different functions will be denoted by different reference numerals 320B, 350F, respectively, and the other components having the same functions will be denoted by the same reference numerals and a description thereof will be omitted.

The speaker structure according to the eighth embodiment of the invention is different from the speaker structure according to the fifth embodiment of the invention with respect to the following points. That is, in the speaker structure according to the fifth embodiment, the speaker unit 310 and the weight 350C are fixed in a state where the gap 342 is disposed between the back face of the speaker unit 310 and the front face of the weight 350C. On the other hand, in the speaker structure according to the eighth embodiment of the invention, the weight 350F is joined and attached to a speaker unit 310B with a groove portion 325 formed in the magnetic circuit portion 320B. In the following, only a point of difference will be described.

A speaker apparatus 301C comprises the speaker unit 310B and the weight 350F fixed on the back face side of the speaker unit 310B.

A yoke 321B of the magnetic circuit portion 320B forming the speaker unit 310B is composed of the center pole 321*a* and the back plate 321*b*. A through hole 324*b* for air bleed is formed in the center of the center pole 321*a*. The concave groove portion 325 that runs to an outer peripheral surface of the yoke 321B about a through hole opening of the through hole 324*b* and has a cross shape when seen from the back face is formed on the back face of the yoke 321B. The through hole opening of the through hole 324*b* is processed into a tapered shape.

The weight 350F includes a main body portion 351C made of nonmagnetic metal having a substantially truncated cone shape, and the screwing portion 354 extending in the radial direction from an outer peripheral portion of the front face of the main body portion 351C, and a convex portion 356A having a substantially cone shape is formed on a central portion on the front face side.

The speaker unit 310B and the weight 350F are combined in the following manner. That is, firstly, the weight 350F is placed on the back face side of the speaker unit 310B in a manner that the screw hole 321*c* and the screw hole 355 overlie each other. Then, the screw tools 360 are inserted from the back face side into the screw holes 355 disposed in several places on the weight 350F, and the front end portions of the screw tools 360 are screwed into the respective screw holes 321*c* of the speaker unit 310B, whereby the combination is completed.

The high-temperature air radiated into the interior space 341 when the speaker unit 310B is driven is discharged from the interior space 341 to the outside on the side face side of the magnetic circuit portion 320B via the through hole 324*b* and the groove portion 325 when the cone 331 is pressed backward. The outside air is sucked into the interior space 341 from the outside on the side face side of the magnetic circuit portion 320B via the groove portion 325 and the through hole 324*b* when the cone 331 is drawn back forward, with the result that the cooling efficiency of the yoke 321B is increased by the air from the outside.

Besides, since the heavy weight 350F is fixed on the back face side of the magnetic circuit portion 320B, even if a reaction force occurring when sound waves radiated from the cone 331 to the surrounding air transmits to the magnetic circuit portion 3208, the weight 350F works as a virtual around, with the result that a firm footing is formed, vibrations are suppressed, and an amplitude operation of the cone is executed faithfully to audio signals.

In accordance with the speaker structure according to the eighth embodiment of the invention, it is possible to make the interior space 341 of the speaker unit 310B and the outside communicate with each other via the through hole 324*b* formed in the yoke 321B and the groove portion 325, and it is possible to obtain both the effect by air bleed and the effect by the weight 350F as in the speaker structure according to the second embodiment of the invention.

Figure 19A:
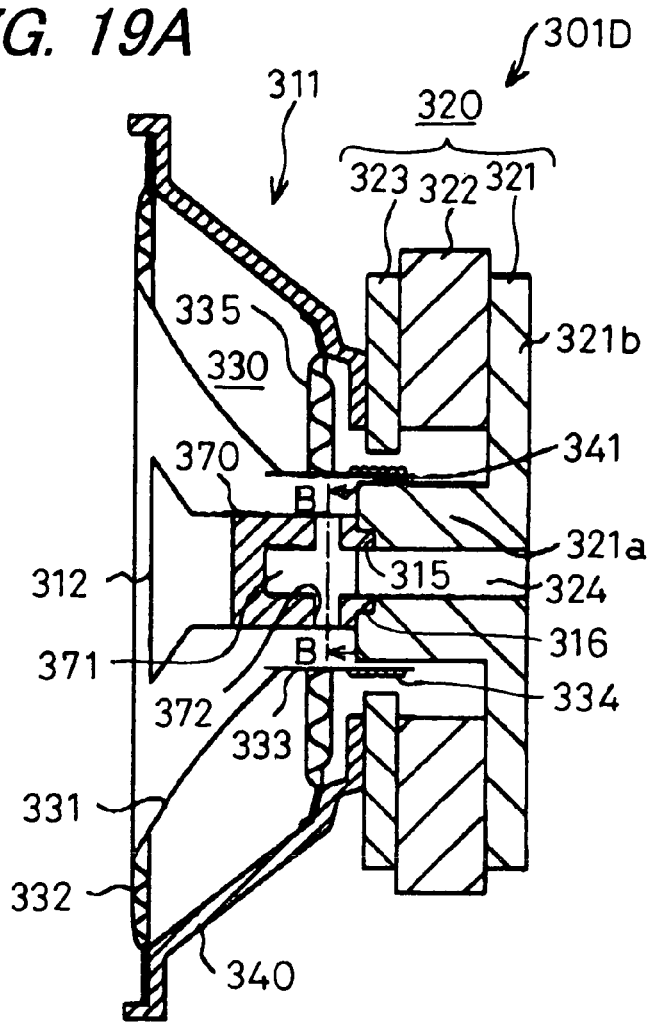
FIGS. 19A and 19B are views schematically showing a speaker structure according to a ninth embodiment of the invention.
Figure 19B:
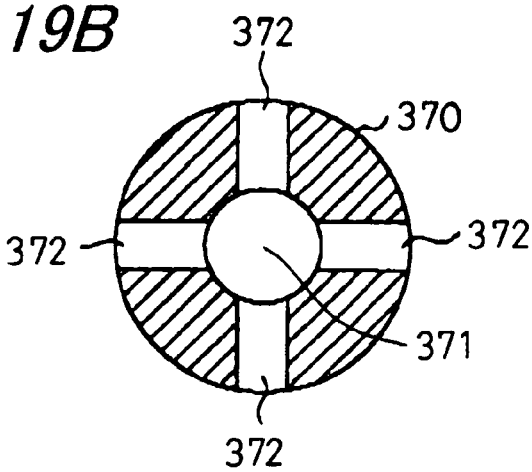

FIGS. 19A and 19B are views schematically showing a speaker structure according to a ninth embodiment of the invention, FIG. 19A is a sectional side view, and FIG. 195 is a sectional view taken on line B-B in FIG. 19A.

A speaker apparatus 301D, which has a so-called two-way type of speaker structure, comprises a main speaker unit 311 having the magnetic circuit portion 320, the vibrating portion 330 and the frame 340, a center support 370 fixed on the front face side of the center pole 321*a* of the magnetic circuit portion 320, and a tweeter unit 312 adhered and fixed on the front face side of the center support 370.

The through hole 324 for air bleed is formed in the magnetic circuit portion 320, more specifically the center pole 321*a*, of the main speaker unit 311 along the central axis thereof. At the through hole opening of the through hole 324 on the front face side of the center pole 321*a*, a concave portion 315 for defining an attachment position of the center support 370 is formed.

The center support 370 having a substantially cylindrical shape is made of a nonmagnetic substance (for example, resin, aluminum, and stainless steel), and provided with a hole portion 371 for air bleed communicating with the through hole 324, and a through hole 372 pierced from an inner wall surface of the hole portion 371 to an outer peripheral surface of the center support 370. On a surface joined to the center pole 321*a* of the center support 370, a convex portion 316 for fitting into a concave portion 315 of the front face of the center pole 321*a* is formed. The through hole 372 is formed as near the center pole 321*a* as possible so as to increase the cooling efficiency of the magnetic circuit portion 320.

The tweeter unit 312 is a speaker for high audio frequencies, and includes a magnetic circuit portion, a vibrating portion, and a frame, which are not shown in the drawings.

The main speaker unit 311 and the center support 370 are combined in the following manner. That is the enter support 370 is placed on the front face of the center pole 321*a*, and the convex portion 316 of the center support 370 is fitted and fixed into the concave portion 315 of the center pole 321*a* in a state where an adhesive or the like is interposed.

The high-temperature air radiated into the interior space 341 when the speaker unit 311 is driven is discharged from the interior space 341 to the outside on the back face side of the magnetic circuit portion 320 via the through hole 372, the hole portion 371 and the through hole 324 when the cone 331 is pressed backward. The outside air is sucked into the interior space 341 from the outside on the back face side of the magnetic circuit portion 320 via the through hole 324, the hole portion 371 and the through hole 372 when the cone 331 is drawn back forward, with the result that the cooling efficiency of the yoke 321 is increased by the air from the outside.

In accordance with the speaker structure according to the ninth embodiment of the invention, it is possible to make the interior space 341 of the main speaker unit 311 and the outside communicate with each other, by the through hole 372 and the hole portion 371 formed in the center support 370 and the through hole 324 formed in the center pole 321*a*, and even in a two-way type of speaker structure, it is possible to obtain the effect by air bleed described above.

Figure 20A:
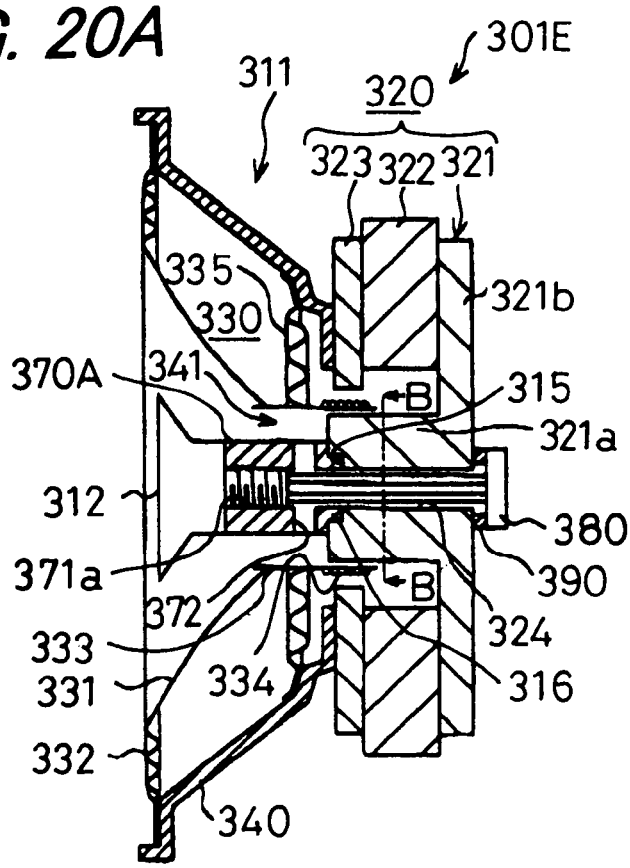
FIGS. 20A to 20E are views schematically showing a speaker structure according to a tenth embodiment of the invention.
Figure 20B:
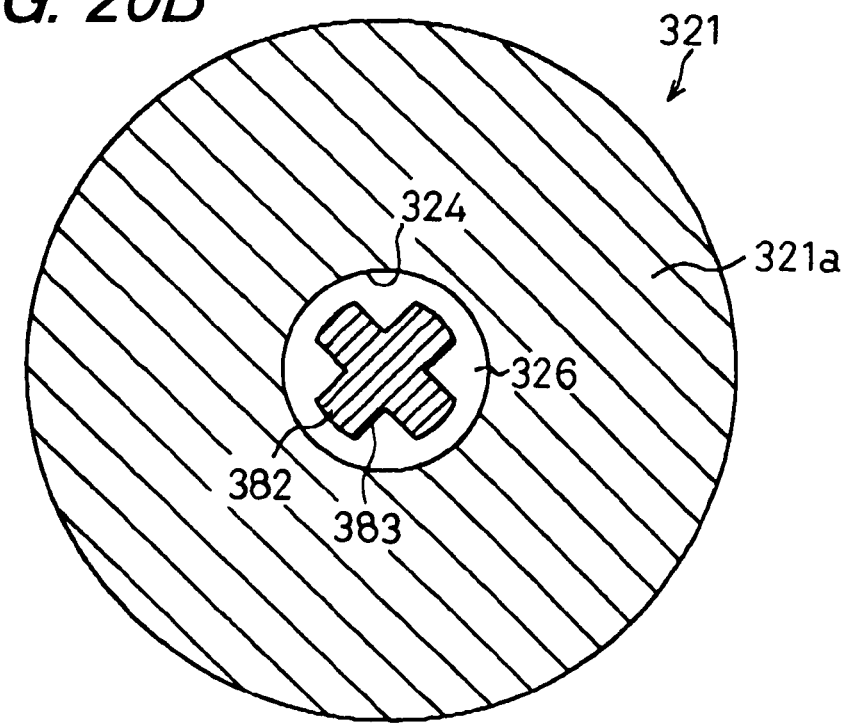

FIGS. 20A and 20B are views schematically showing a speaker structure according to a tenth embodiment of the invention, FIG. 20A is a sectional side view and FIG. 20B is a sectional view taken on line B-B in FIG. 20A. Here, in the embodiment components having the same functions as those of the two-way type of speaker structure shown in FIGS. 19A and 19B will be denoted by the same reference numerals and a description thereof will be omitted.

The speaker structure according to the tenth embodiment of the invention is different from the speaker structure according to the ninth embodiment of the invention in the following points. That is, in the speaker structure according to the ninth embodiment of the invention, the speaker unit 311 and the center support 370 are adhered and fixed in a state where the through hole 324 and the hole portion 371 of the center support 370 communicate with each other. On the other hand, in the speaker structure according to the tenth embodiment of the invention, the main speaker unit 311 and a center support 370A are fixed by a screw tool 380. In the following, only a point of difference will be described.

A speaker apparatus 301E, which has a so-called two-way type of speaker structure, comprises the main speaker unit 311, the center support 370A and the tweeter unit 312.

In the center support 370A having a substantially cylindrical shape, a hole portion 371*a* and the through hole 372 are formed. The hole portion 371*a* has an air bleed function and a screwing function. The through hole 372 is pierced from an inner wall surface of the hole portion 371*a* to an outer peripheral surface of the center support 370A. A screw thread for screwing the screw tool 380 is cut in the hole 371*a* on the front face side of the through hole 372.

Figure 20C:
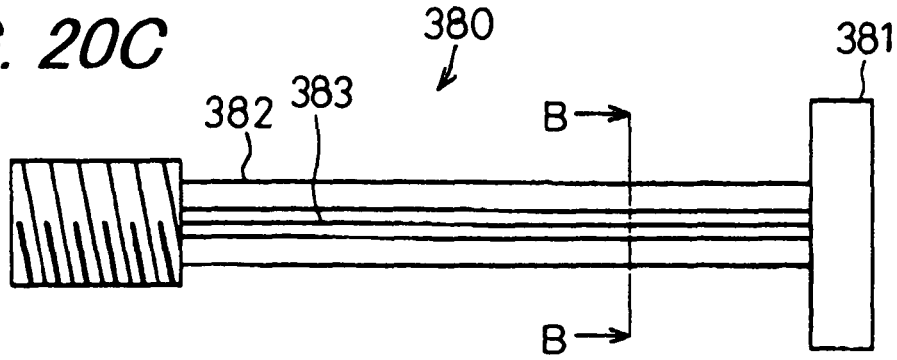
Figure 20D:
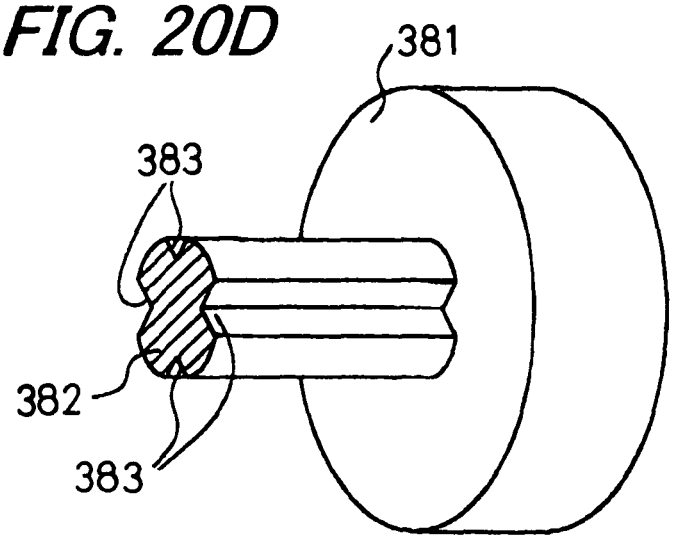
Figure 20E:
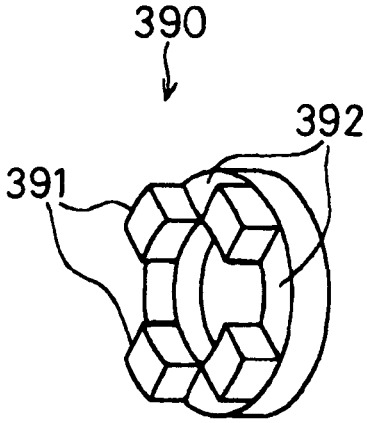

FIGS. 20C to 20E are views schematically showing the screw tool 380 and a washer 390 (a fixing auxiliary member of the screw tool 380), FIG. 20C is a side view of the screw tool 380, FIG. 20D is a sectional perspective view taken on line B-B in FIG. 20C, and FIG. 20E is a perspective front view of the washer 390.

The screw tool 380 is composed of a head portion 381 and a foot portion 382. A screw thread is cut on a front end portion of the foot portion 382 (the screwing portion on the front face side of the through hole 372), a portion except the front end portion of the foot portion 382 is processed smaller in diameter than the front end portion, and the section thereof is processed into an X shape. Four groove portions 383 are formed along the foot portion 382 by the X-shape processing.

The annular washer 390 has convex portions 391 and concave portions 392 on the front face side, and has a shape such that the concave portions 392 can be placed in positions corresponding to the groove portions 383 of the screw tool 380.

The main speaker unit 311 and the center support 370A are combined in the following manner. That is, firstly, the convex portion 316 formed at the through hole opening of the through hole 371*a* of the center support 370A is fitted into the through hole opening of the through hole 324 having the concave portion 315 on the front face side of the center pole 321*a*. Next, the screw tool 380 is inserted into the through hole 324 via the washer 390 from the back face side of the main speaker unit 311, and the front end portion of the screw tool 380 is screwed into a portion with a screw thread cut of the hole portion 371*a* of the center support 370A, whereby the combination is completed.

According to the speaker structure after combination, a communicating passage 326 that runs from the interior space 341 of the main speaker unit 311 to the outside on the back face side of the magnetic circuit portion 320 is formed by the through hole 372 of the center support 370A, a gap between the inner wall of the hole portion 371*a* and the foot portion 382 of the screw tool 380, a gap between the inner wall of the through hole 324 and the foot portion 392 of the screw tool 380, and a gap between the concave portion 392 of the washer 390 and the back face of the yoke 321.

The high-temperature air radiated into the interior space 341 when the main speaker unit 311 is driven is discharged from the interior space 341 to the outside on the back face side of the magnetic circuit portion 320 via the communicating passage 326 when the cone 331 is pressed backward. The outside air is sucked into the interior space 341 from the outside on the back face side of the magnetic circuit portion 320 via the communicating passage 326 when the cone 331 is drawn back forward, with the result that the cooling efficiency of the yoke 321 is increased by the air from the outside.

In accordance with the speaker structure according to the tenth embodiment of the invention, even when the main speaker unit 311 and the center support 370A are fixed by the screw tool 380, it is possible to form the communicating passage 326 by the through hole 372 of the center support 370A, the gap between the inner wall of the hole portion 371*a* and the foot portion 382 of the screw tool 380, the gap between the inner wall of the through hole 324 and the foot portion 382 of the screw tool 380 and the gap between the concave portion 392 of the washer 390 and the back face of the yoke 321, and make the interior space 341 of the main speaker unit 311 and the outside on the back face side of the magnetic circuit portion 320 communicate with each other, and even in a two-way type of speaker, it is possible to obtain the effect by air bleed as described above.

Figure 21A:
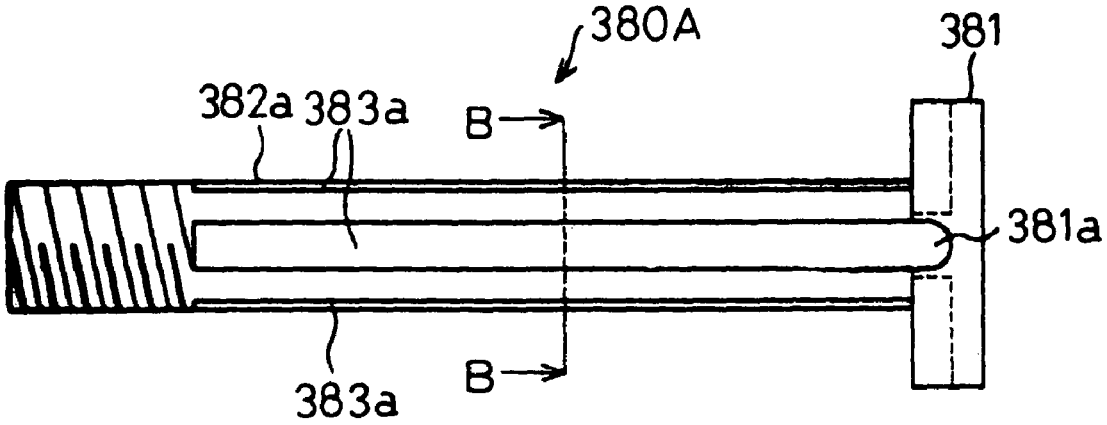
FIGS. 21A and 21B are views schematically showing a screw tool in a speaker structure according to an eleventh embodiment of the invention.
Figure 21B:
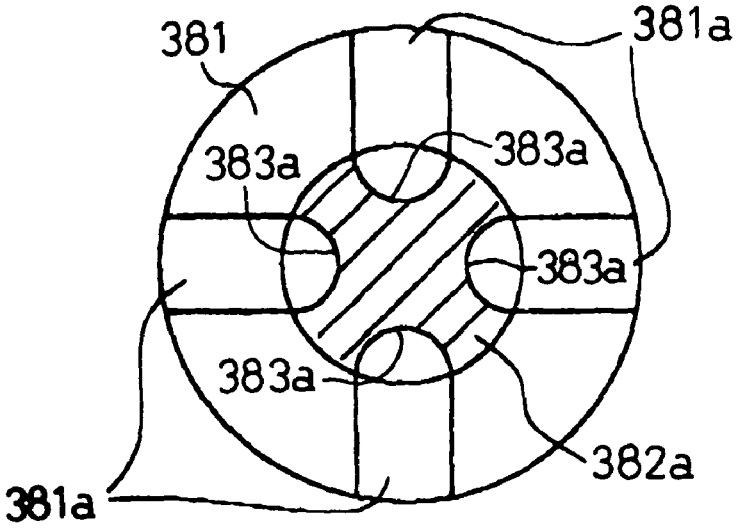
Figure 22A:
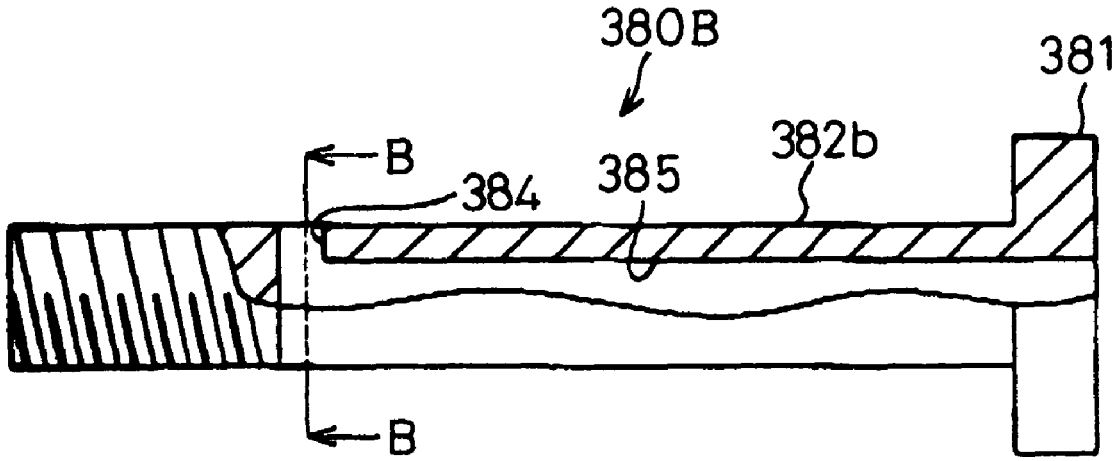
FIGS. 22A and 22B are views schematically showing a screw tool in a speaker structure according to a twelfth embodiment of the invention.
Figure 22B:
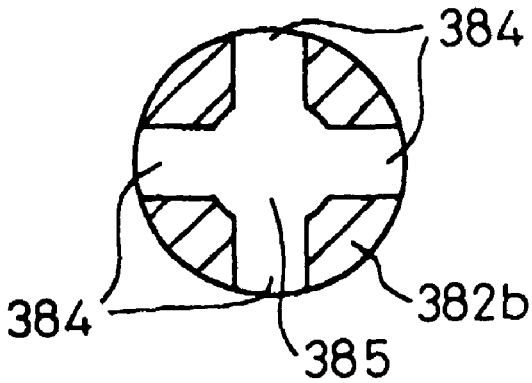

Although the screw tool 380 used in the speaker structure according to the tenth embodiment of the invention is a screw tool having the foot portion 382 that the diameter of a portion except the front end portion with a screw thread cut is processed small, a screw tool 80A as shown in FIGS. 21A and 21B and a screw tool 380B as shown in FIGS. 22A and 22B can also be used in eleventh and twelfth embodiments of the invention.

FIGS. 21A and 21B are views schematically showing a screw tool 380A in a speaker structure according to an eleventh embodiment of the invention, FIG. 21A is a side view, and FIG. 21B is a sectional view taken on line B-B in FIG. 21A. The screw tool 380A shown in FIGS. 21A and 21B has a foot portion 382*a* whose diameter is uniform from a front end portion to the head portion 381, and a screw thread is cut on a front end portion of the foot portion 382*a*. On the foot portion 382*a*, a groove portion 383*a* whose section is formed into a semicircular arch is formed from a specified position (a position corresponding to the through hole 372 of the center support 370A) to a base of the head portion 381 along the foot portion 382*a*.

Further, the head portion 381 is provided with a groove portion 381*a* coupled to the groove portion 383*a*. When the screw tool 380A is used, it is possible to form a communicating passage by the through hole 372 of the center support 370A, the groove portion 363*a* of the screw tool 380A and the groove portion 381*a* of the head portion 381 of the screw tool 380A. Moreover, as a result of providing the head portion 381 with the groove portion 381*a*, it is possible to use a normal flat washer which does not have concave portions or convex portions, so that there is no need to align the concave portions and the convex portions of the washer with the groove portion 383 of the foot portion 382 as in the tenth embodiment of the invention, and a combining operation is facilitated.

FIGS. 22A and 22B are views schematically showing a screw tool 380B in a speaker structure according to a twelfth embodiment of the invention, FIG. 22A is a partial sectional side view, and FIG. 22B is a sectional view taken on line B-B in FIG. 22A. The screw tool 380B shown in FIGS. 22A and 22B has a foot portion 382*b* whose diameter is uniform from a front end portion to the head portion 381, and a screw thread is cut on a front end portion of the foot portion 382*b*. On the side face of the foot portion 382*b*, a through hole 384 is formed in a position corresponding to the through hole 372 of the center support 370A, and an axis hole 365 coupled to the through hole 384 is formed along the center axes of the head portion 381 and the foot portion 382*b*.

When using the screw tool 380B, it is possible to form a communicating passage by the through hole 372 of the center support 370A, the through hole 384 and the axis hole 385 of the screw tool 380B. Moreover, as a result of also providing the head portion 381 with the axis hole 385, it is possible to use a normal flat washer which does not have concave portions or convex portions, so that there is no need to align the concave portions and the convex portions of the washer 390 with the groove portion 383 of the screw tool 380 as in the tenth embodiment of the invention, and a combining operation is facilitated.

Figure 23A:
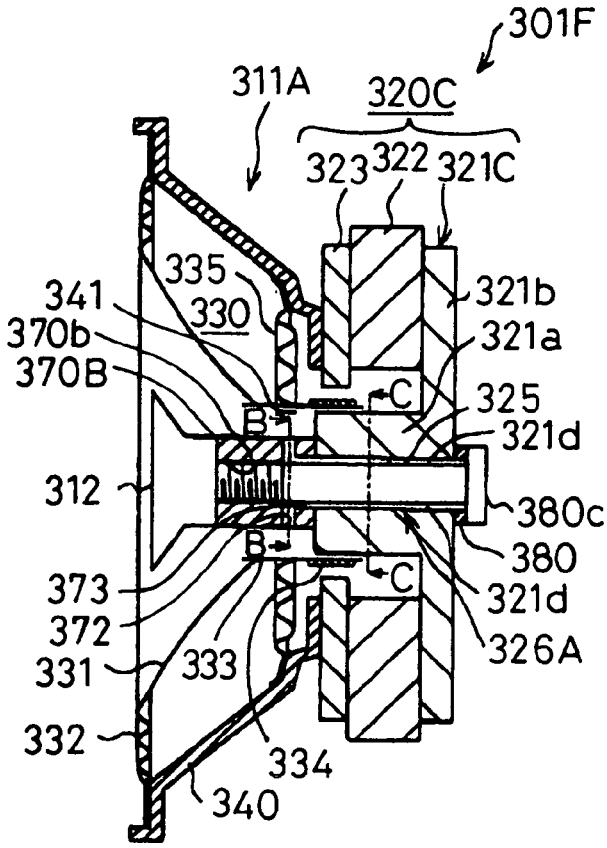
FIGS. 23A to 23C are views schematically showing a speaker structure according to a thirteenth embodiment of the invention.
Figure 23B:
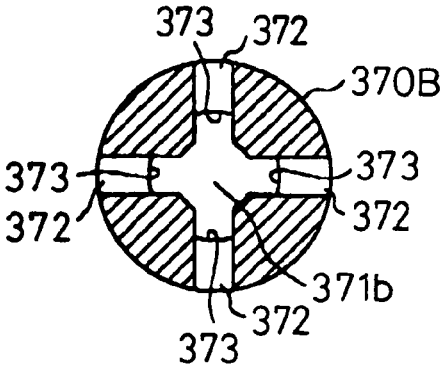
Figure 23C:
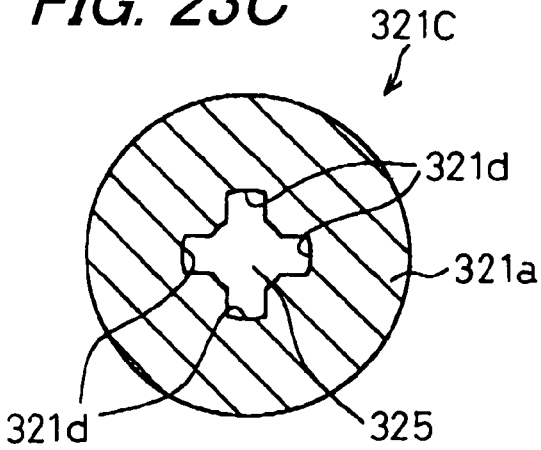

FIGS. 23A to 23C are views schematically showing a speaker structure according to a thirteenth embodiment of the invention, FIG. 23A is a sectional side view, FIG. 23B is a sectional view taken on line B-B in FIG. 23A, and FIG. 23C is a sectional view taken on line C-C in FIG. 23A. Here, in the embodiment of the invention, components having the same functions as those of the two-way type of speaker structure shown in FIG. 19 will be denoted by the same reference numerals and a description thereof will be omitted.

The speaker structure according to the thirteenth embodiment of the invention is different from the speaker structure according to the tenth embodiment of the invention with respect to the following points. That is, in the speaker structure according to the tenth embodiment of the invention, the shape of the screw tool 380 is processed and the communicating passage 326 for air bleed is thereby formed in the hole portion 371*a* and the through hole 324. On the other hand, in the speaker structure according to the thirteenth embodiment of the invention, the shape of a hole portion 371*b* of a center support 370B and the shape of a through hole 325 of a yoke 321C are processed instead of the shape of a screw tool and a communicating passage 326A for air bleed is thereby formed. In the following, only a point of difference will be described.

A speaker apparatus 301F, which has a so-called two-way type of speaker structure, comprises a main speaker unit 311A, the center support 370B and the tweeter unit 312.

The through hole 325 for inserting a screw tool 380C is formed in a magnetic circuit portion 320C, more specifically the center pole 321*a*, of the main speaker unit 311A along the central axis thereof. Groove portions 321*d* for air bleed formed alone the inner wall of the through hole 325 are disposed at equal intervals in four places on the center pole 321*a*.

In the center support 370B having a substantially cylindrical shape, the hole portion 371*b*, the through hole 372 and groove portion 373 are formed. The hole portion 371*b* inserts the screw tool 380C. The through hole 372 is pierced from the inner wall surface of the hole portion 371*b* to the outer peripheral surface of the center support 370B. The groove portion 373 for air bleed is coupled to the through hole 372 and formed along the inner wall surface of the hole portion 371*b*. A screw thread for screwing the screw tool 380C is cut on the hole portion 371*b* on the front face side of the through hole 372.

On a joining surface between the center support 370B and the center pole 321*a*, means for aligning the groove portion 373 and the groove portion 321*d* (for example, a concave portion and a convex portion to be engaged when the center support 3705 and the center pole 321*a* are aligned) is formed.

The main speaker unit 311A and the center support 370B are combined in the following manner. That is, the center support 370B is placed or the front face of the center pole 321*a* in a manner that the groove portion 373 and the groove portion 321*d* overlie each other. Next, the screw tool 380C is screwed from the back face side of the main speaker unit 311A into the through hole 325 via the washer (fixing auxiliary member) 390, whereby the combination is completed.

According to the speaker structure after combination, the communicating passage 326A running from the interior space 341 of the main speaker unit 311A to the outside on the back face side of the magnetic circuit portion 320C is formed by the through hole 372 of the center support 370B, the groove portion 373 on the inner wall of the hole portion 371*b*, the groove portion 321*d* on the inner wall of the through hole 325 and a gap between the concave portion 392 (refer to FIG. 20E) of the washer 390 and the back face of the yoke 321.

The high-temperature air radiated into the interior space 341 when the main speaker unit 311A is driven is discharged from the interior space 341 to the outside on the back face side of the magnetic circuit portion 320C via the through hole 372, the groove portion 373, the groove portion 321*d* and a gap of the concave portion 392 of the washer 390, namely the communicating passage 326A, when the cone 331 is pressed backward. The outside air is sucked into the interior space 341 from the outside on the back face side via the communicating passage 326A when the cone 331 is drawn back forward, with the result that the cooling efficiency of the yoke 321C is increased by the air from the outside.

In accordance with the speaker structure according to the thirteenth embodiment of the invention, even when the main speaker unit 311A and the center support 370B are fixed by the screw tool 380C, the communicating passage 326A is formed by the through hole 372, the groove portion 373 formed on the inner wall of the hole portion 371*a*, the groove portion 321*d* formed on the inner wall surface of the through hole 325 and the gap of the concave portion 392 of the washer 390, it is possible to make the interior space 341 of the main speaker unit 311A and the outside communicate with each other, and even in a two-way type of speaker, it is possible to obtain the effect by air bleed as described above.

Figure 24:
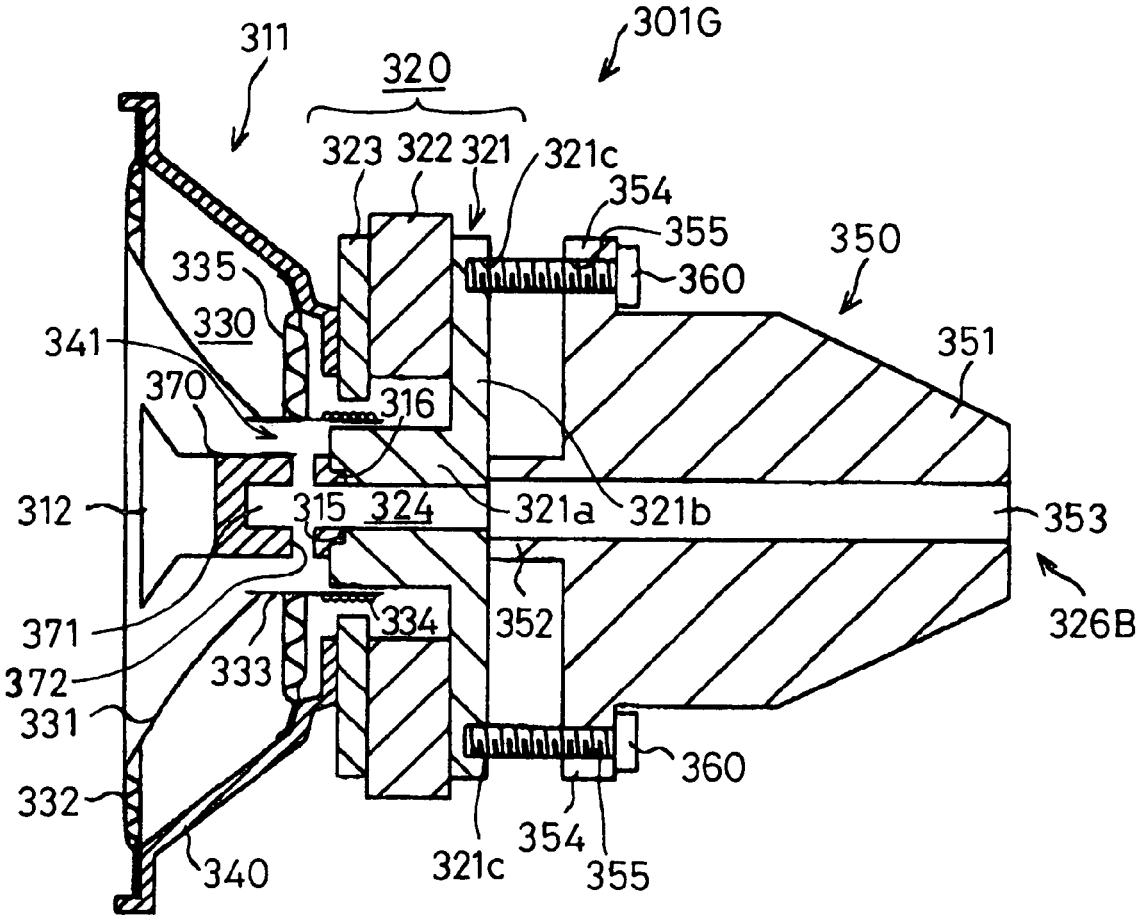
FIG. 24 is a sectional side view schematically showing a speaker structure according to a fourteenth embodiment of the invention.

FIG. 24 is a sectional side view schematically showing a speaker structure according to a fourteenth embodiment of the invention. Here, the speaker structure according to the embodiment is structured in a manner that the weight 350 used in the speaker apparatus 301 shown in FIG. 12 is attached on the back face side of the two-way type of speaker apparatus 301D according to the ninth embodiment of the invention shown in FIG. 19, so that components having the same functions will be denoted by the same reference numerals and a description thereof will be omitted.

A speaker apparatus 301G comprises the main speaker unit 311 that the tweeter unit 312 and the center support 370 are placed, and the weight 350.

The main speaker unit 311 and the weight 350 are combined in the following manner. That is, the weight 350 is placed on the back face side of the main speaker unit 310, and the protruding portion 352 is positioned in a manner that the through hole 324 formed on the center pole 321*a* and the through hole 353 of the weight 350 communicate with each other. In addition, the screw tools 360 is inserted from the back face side into the screw holes 355 disposed in several places on the screwing portion 354 of the weight 350, and the front end portions of the screw tools 360 is screwed into the respective screw holes 321*c* of the speaker unit 310.

According to the speaker structure after combination, a communicating passage 326B running from the interior space 341 of the main speaker unit 311 to the outside on the back face side of the weight 350 is formed by the through hole 372 of the center support 370, the hole portion 371, the through hole 324, and the through hole 353 of the weight 350.

The high-temperature air radiated into the interior space 341 when the main speaker unit 311 is driven is discharged from the interior space 341 to the outside on the back face side of the weight 350 via the through hole 372, the hole portion 371, the through hole 324, and the through hole 353 of the weight 350, namely the communicating passage 326B, when the cone 331 is pressed backward. The outside air is sucked into the interior space 341 from the outside on the back face side of the weight 350 via the communicating passage 326B when the cone 331 is drawn back forward, with the result that the cooling efficiency of the yoke 321 is increased by the air from the outside.

Besides, since the heavy weight 350 is fixed on the back face side of the magnetic circuit portion 320, even if a reaction force occurring when sound waves are radiated from the cone 331 to the surrounding air transmits to the magnetic circuit portion 320, the weight 350 works as a virtual ground, with the result that a firm footing is formed, vibrations are suppressed, and an amplitude operation of the cone is executed faithfully to audio signals.

In accordance with the speaker structure according to the fourteenth embodiment of the invention, it is possible to make the interior space 341 of the main speaker unit 311 and the outside on the back face side of the weight 350 communicate with each other by the through hole 372, the hole portion 371, the through hole 324 and the through hole 353, and even in a two-way type of speaker, it is possible to attach the weight 350 in a state where the effect by air bleed as described above can be obtained, it is possible to suppress vibrations of the main speaker unit 311 and cause the cone 331 to efficiently output sound waves, and it is possible to further increase an acoustic characteristics.

Figure 25:
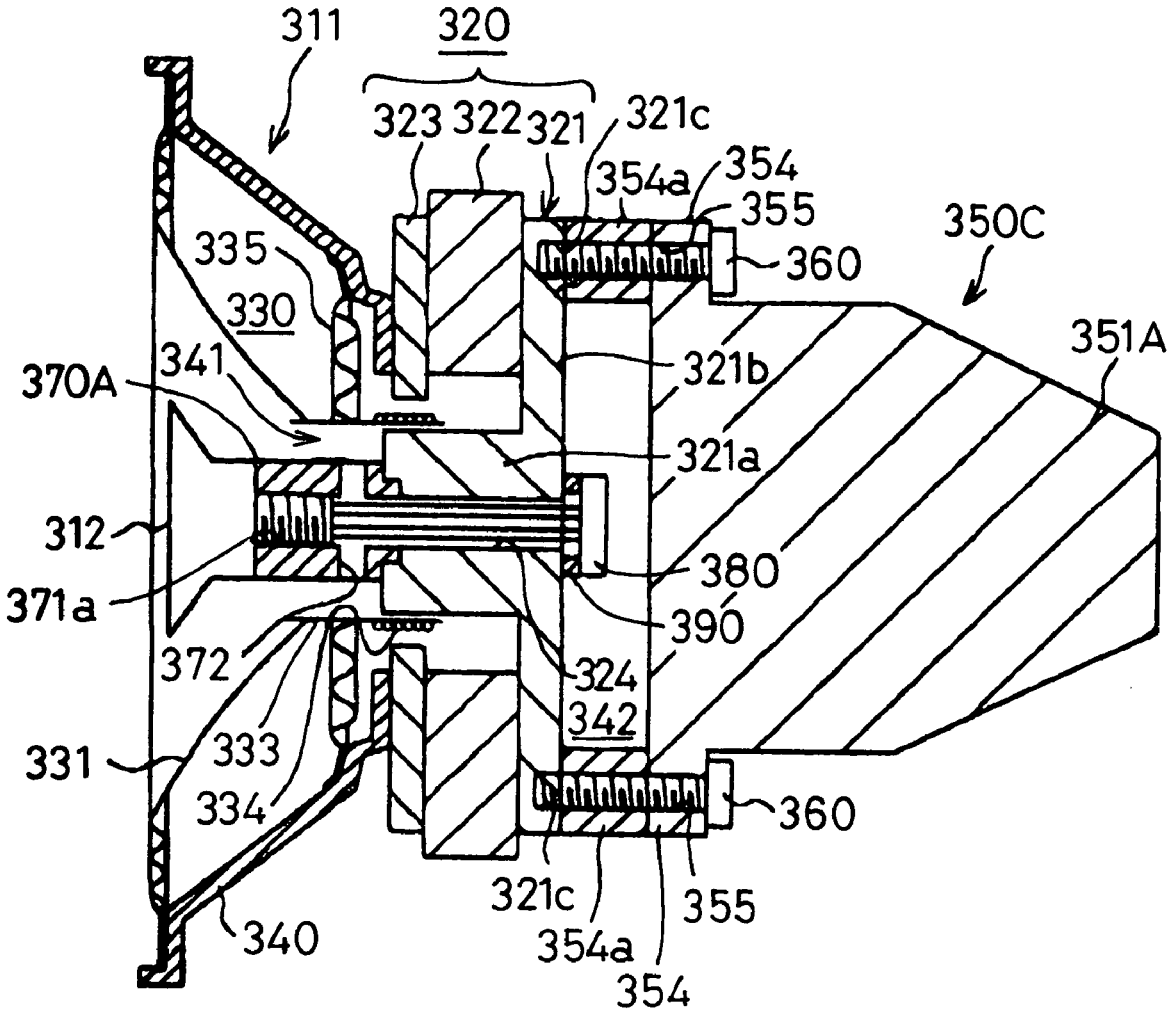
FIG. 25 is a sectional side view schematically showing a speaker structure according to a fifteenth embodiment of the invention.
Figure 26:
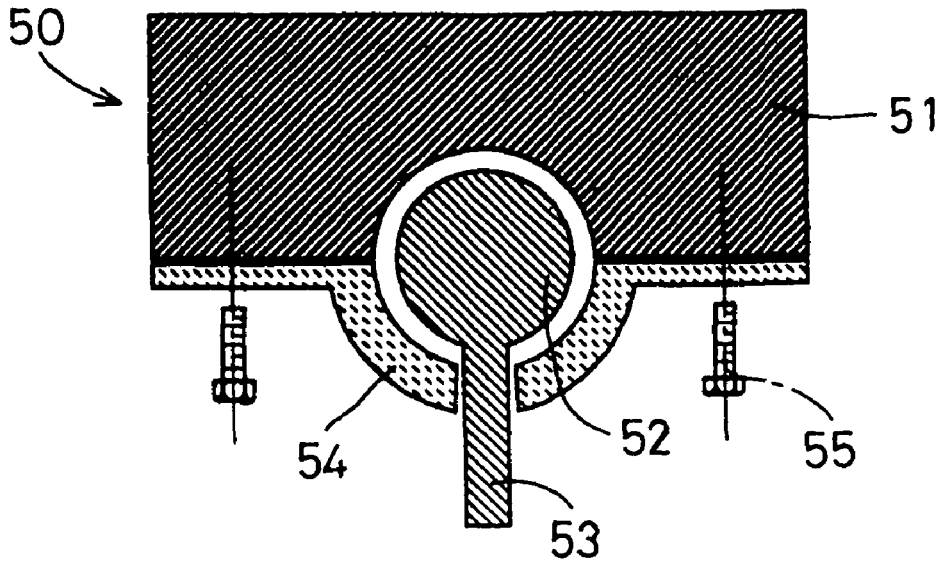
FIG. 26 PRIOR ART
FIG. 26 is a partial sectional view of a conventional supporting apparatus which enables a swing.
Figure 27:
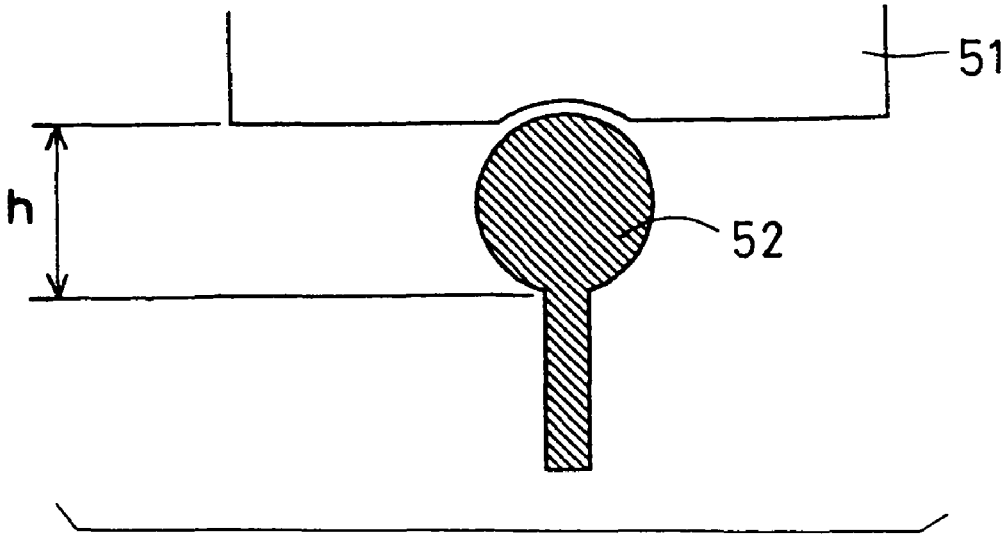
FIG. 27 PRIOR ART
FIG. 27 is a partial sectional view of a conventional supporting apparatus which enables a swing.
Figure 28:
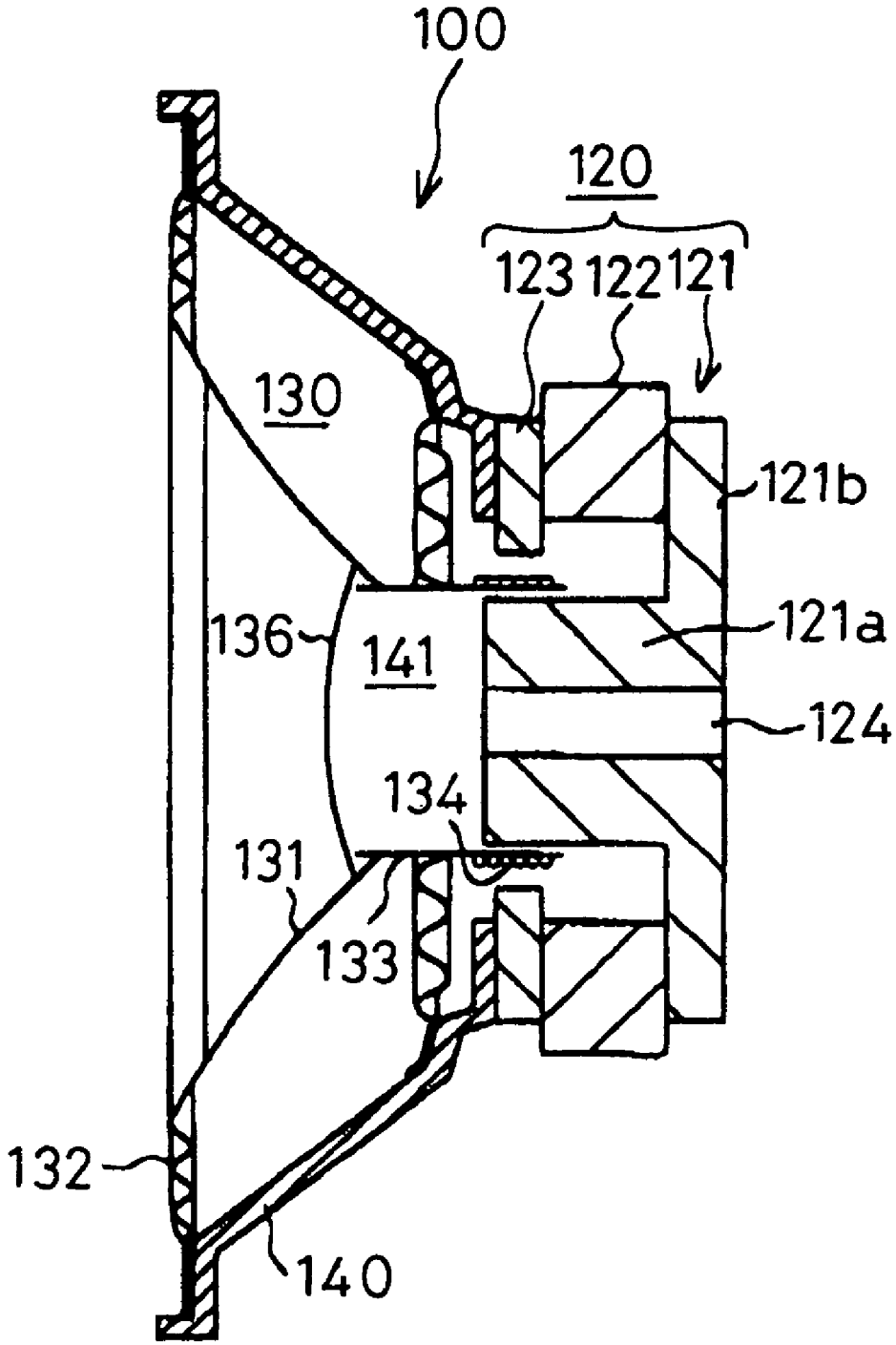
FIG. 28 PRIOR ART
FIG. 28 is a sectional side view schematically showing a conventional speaker structure.
Figure 29:
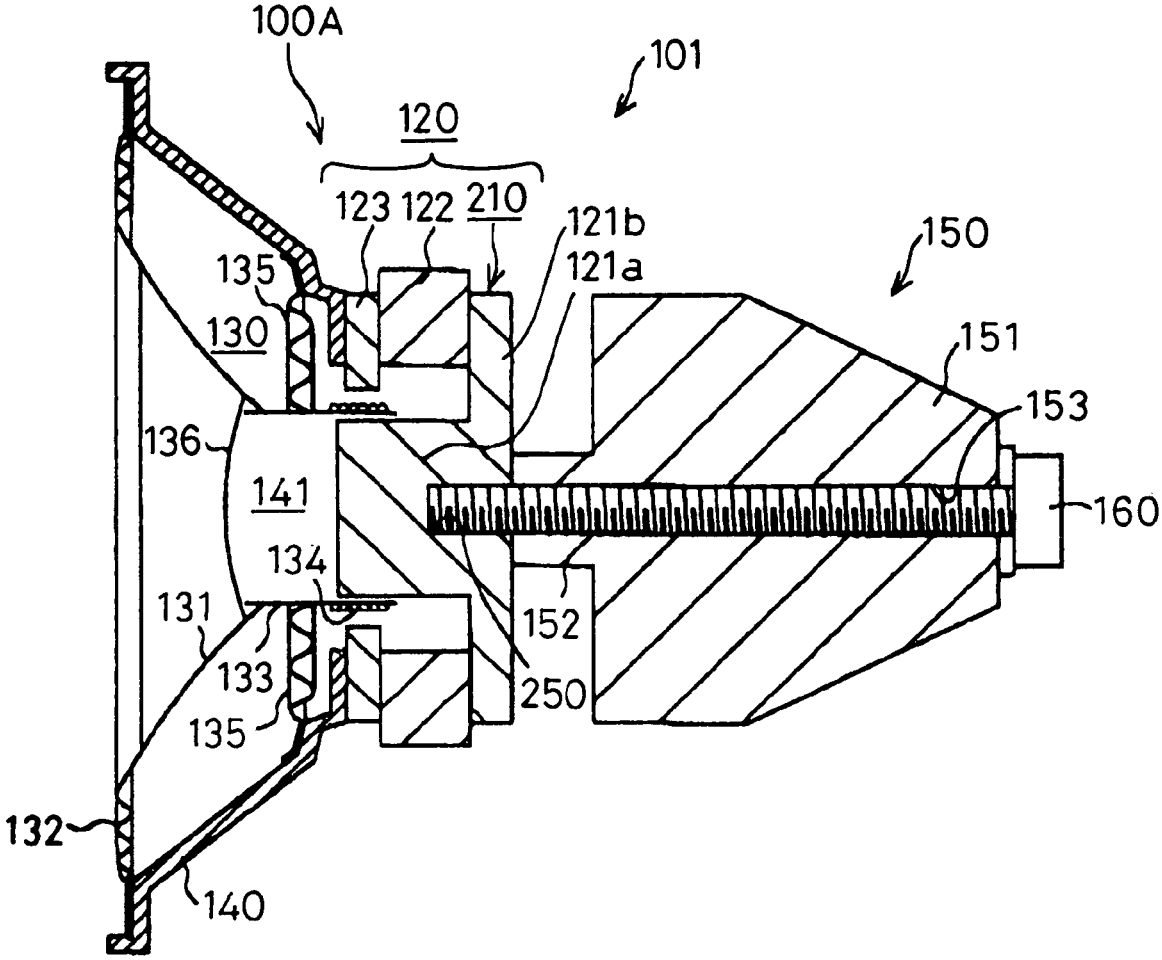
FIG. 29 PRIOR ART
FIG. 29 is a sectional side view schematically showing another conventional speaker structure.
Figure 30:
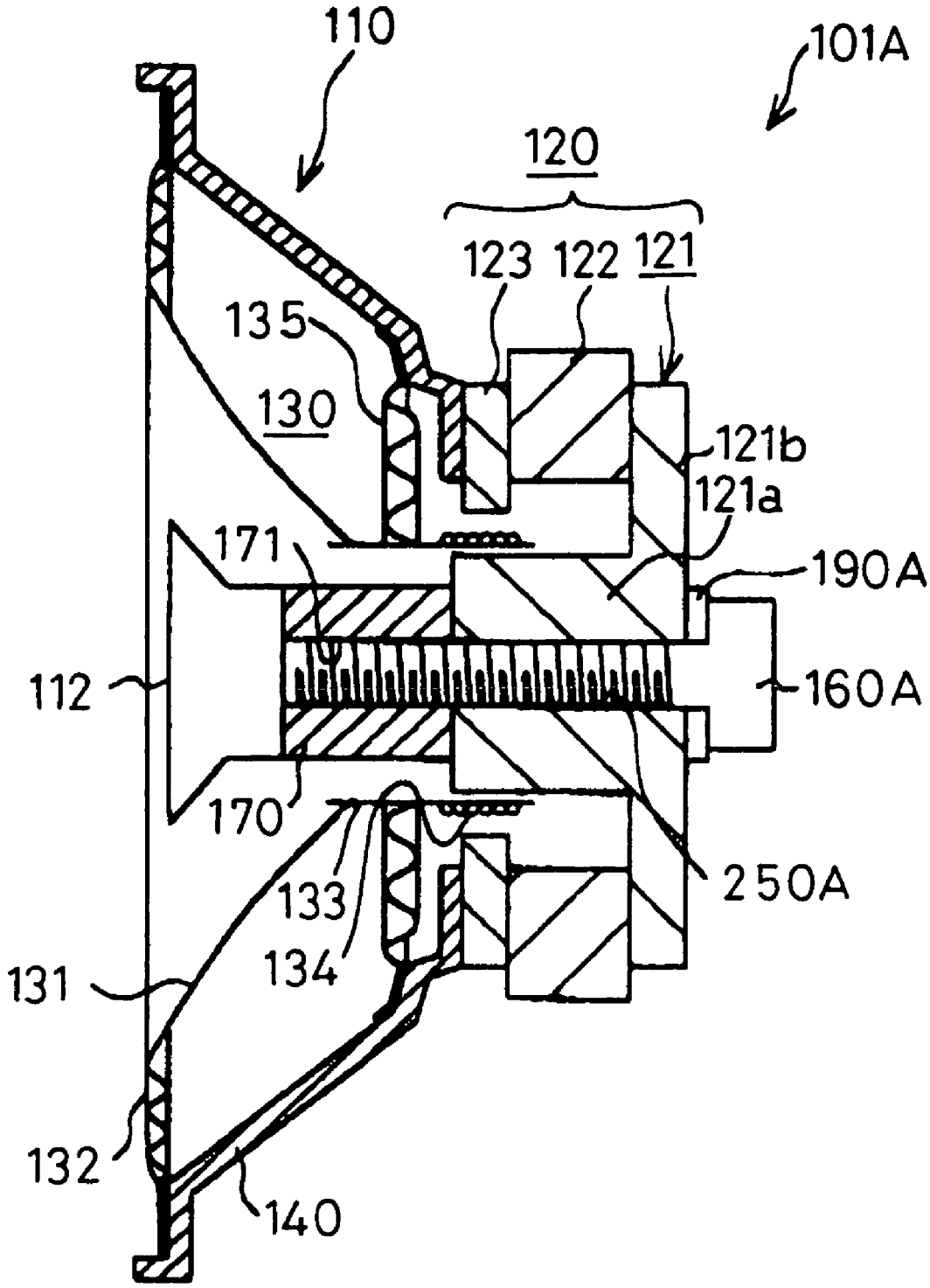
FIG. 30 PRIOR ART
FIG. 30 is a sectional side view schematically showing a conventional two-way type of speaker structure.

In a fifteenth embodiment of the invention, it is possible to structure as shown in FIG. 25 such that the weight 350C used in the speaker apparatus 301A shown in FIG. 15 is attached to the two-way type of speaker apparatus 301E according to the tenth embodiment of the invention shown in FIG. 20A. Also according to the structure, it is possible to obtain almost the same effect as in the speaker structure according to the fourteenth embodiment of the invention.

In addition, the speaker structures according to the second to fifteenth embodiments may be mounted on the speaker apparatus according to the first embodiment.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A speaker structure, comprising:

a speaker unit having a magnetic circuit portion provided with a first through hole;

a weight fixed on a back face side of the speaker unit and having a main body portion provided with a second through hole that is not a vented fastener, the first through hole communicating with the second through hole; and a protrusion around an end of the second through hole of the weight, the end being on a side communicating with the first through hole, wherein the weight is attached to the speaker unit in a state in which the first through hole and the second through hole communicate mutually via the protrusion.

* * * * *